US010524525B2

(12) United States Patent
Yazdi et al.

(10) Patent No.: US 10,524,525 B2
(45) Date of Patent: Jan. 7, 2020

(54) SUIT DESIGNS AND DOFFING METHODOLOGIES FOR PERSONAL PROTECTIVE EQUIPMENT TO PREVENT THE SPREAD OF INFECTIOUS AGENTS TO HEALTHCARE WORKERS

(71) Applicant: The Johns Hopkins University, Baltimore, MD (US)

(72) Inventors: Youseph Yazdi, Baltimore, MD (US); Melody Tan, Baltimore, MD (US); Matthew Petney, Baltimore, MD (US); William Alexander LeMay Patterson, Baltimore, MD (US); Siavash Parkhideh, East Setauket, NY (US); Jill Andrews, Baltimore, MD (US); Patience Osei, Baltimore, MD (US); Soumyadipta Acharya, Baltimore, MD (US); Chandrakant Ruparelia, Baltimore, MD (US); HarshadKumar Sanghvi, Baltimore, MD (US); Timothy Patrick Harrigan, Baltimore, MD (US); Nahyun Kate Cho, Baltimore, MD (US); Qian Liu, Baltimore, MD (US); Brandon Craft, Baltimore, MD (US); Paul Fearis, Baltimore, MD (US); Sami Messai, Baltimore, MD (US); Brian Ma, Baltimore, MD (US); Meagan Hawes, Baltimore, MD (US); Reeve Ilse Heinis, Baltimore, MD (US); Jason Onslow Leroy Johnson, Baltimore, MD (US); Erin Reisfeld, Baltimore, MD (US); Arjun Shailesh Vachhani, Baltimore, MD (US); Timothy Campbell, Baltimore, MD (US); Neil Rens, Baltimore, MD (US); Madeleine Clegg, Baltimore, MD (US); Elizabeth Anne Stokley, Baltimore, MD (US); Jessica Jeang, Baltimore, MD (US); Christopher Chiang, Baltimore, MD (US); Willibrord Shasha, Baltimore, MD (US); Bailey Topper, Baltimore, MD (US); Kimberly Ashman, Baltimore, MD (US); Michael Parlato, Baltimore, MD (US)

(73) Assignee: The Johns Hopkins University, Baltimore, MD (US)

( * ) Notice: Subject to any disclaimer, the term of this patent is extended or adjusted under 35 U.S.C. 154(b) by 917 days.

(21) Appl. No.: 14/968,087

(22) Filed: Dec. 14, 2015

(65) Prior Publication Data

US 2016/0165973 A1 Jun. 16, 2016

Related U.S. Application Data

(60) Provisional application No. 62/091,411, filed on Dec. 12, 2014.

(51) Int. Cl.
*A41D 13/12* (2006.01)
*A41D 27/28* (2006.01)
(Continued)

(52) U.S. Cl.
CPC ..... *A41D 13/1218* (2013.01); *A41D 13/02* (2013.01); *A41D 27/28* (2013.01);
(Continued)

(58) Field of Classification Search
CPC ..... A41D 13/118; A41D 13/02; A41D 27/28; A62B 17/001; A62B 17/006
See application file for complete search history.

(56) References Cited

U.S. PATENT DOCUMENTS 597,883 A * 1/1898 Kepler ..... A41F 19/005 24/15
1,667,583 A * 4/1928 Black ..... A41F 19/00 24/15
(Continued)

OTHER PUBLICATIONS

"CEPAR Tracking and Responding to Ebola," Johns Hopkins Office of Critical Event Preparedness and Response, 2 pages, 2014. Retrieved: <http://www.hopkins-cepar.org/>. [Cited in Specification].
(Continued)

*Primary Examiner* — Richale L Quinn
(74) *Attorney, Agent, or Firm* — Venable LLP; Henry J. Daley; Miguel A. Lopez

(57) ABSTRACT

The present invention relates to bodysuits for use as personal protective equipment comprising a torso portion comprising
(Continued)

a front side; a back side including a sealable port through which a wearer can enter and exit the bodysuit when donning or doffing the bodysuit, respectively; a waist region; a neck opening; a pair of upper limb openings; and a pair of lower limb openings; two arm portions each extending from one of the upper limb opening; and two leg portions each extending from one of the lower limb opening and methods for the removal of such body suits.

34 Claims, 18 Drawing Sheets

(51) Int. Cl.
*A41D 13/02* (2006.01)
*A62B 17/00* (2006.01)

(52) U.S. Cl.
CPC .... *A41D 2300/322* (2013.01); *A41D 2400/44* (2013.01); *A41D 2400/52* (2013.01); *A41D 2400/70* (2013.01); *A62B 17/001* (2013.01); *A62B 17/006* (2013.01)

(56) References Cited

U.S. PATENT DOCUMENTS 2,344,811 A * 3/1944 Gill ..... A41D 13/001 2/173
2,531,805 A * 11/1950 Clark ..... A47G 25/902 29/278
2,840,412 A * 6/1958 Lancaster ..... A47G 25/902 24/302
2,855,603 A * 10/1958 Zito ..... G21F 3/025 2/173
2,881,758 A * 4/1959 Motsinger ..... A62B 17/001 128/201.25
3,125,791 A * 3/1964 Downs ..... A44B 19/262 24/381
3,164,840 A * 1/1965 Reynolds ..... G21F 3/025 2/457
3,249,977 A * 5/1966 Cloud, Sr. ..... A47G 25/902 294/26
3,359,567 A * 12/1967 Zemme ..... G21F 3/025 2/457
3,496,572 A * 2/1970 Herzig ..... A41D 13/02 2/232
5,103,502 A * 4/1992 Grilliot ..... A41D 27/10 2/123
5,975,386 A * 11/1999 Fernicola ..... A47G 25/902 223/111
6,088,833 A 7/2000 Welchel et al.
6,167,572 B1 * 1/2001 Naumovitz ..... A41D 1/06 2/227
7,062,786 B2 * 6/2006 Stinton ..... A41D 13/0005 2/2.15
7,246,382 B2 * 7/2007 Plut ..... A41D 19/0055 2/161.6
7,624,455 B1 * 12/2009 Bhalla ..... A41D 19/0055 2/160
8,234,760 B2 * 8/2012 Vogelsang ..... A44B 19/26 24/387
8,448,264 B2 * 5/2013 Ellsworth ..... A41D 3/00 2/108
8,800,068 B2 * 8/2014 Liu ..... A62B 17/00 2/457
8,910,983 B1 * 12/2014 Neff ..... A47G 25/902 24/429
9,079,091 B2 * 7/2015 Lewis ..... A41D 19/0024
9,301,632 B2 * 4/2016 Harris ..... A44B 19/262
9,498,076 B1 * 11/2016 Reid ..... A44B 19/262
9,643,033 B2 * 5/2017 Yadav ..... A62B 17/006
9,814,341 B2 * 11/2017 Kobyluck ..... A47G 25/90
2004/0006815 A1 * 1/2004 Carroll ..... A62B 17/006 2/457
2005/0204451 A1 * 9/2005 Plut ..... A41D 19/0055 2/161.6
2009/0019616 A1 * 1/2009 Smith ..... A41D 13/02 2/51
2012/0124722 A1 * 5/2012 Yadav ..... G21F 3/025 2/457
2012/0169076 A1 * 7/2012 Brake ..... A47G 25/902 294/3.6
2016/0151648 A1 * 6/2016 Yadav ..... A62B 17/006 2/457
2016/0199674 A1 * 7/2016 Johnson ..... A41D 13/1218 600/549
2017/0120083 A1 * 5/2017 Pratt ..... A41D 13/02
2018/0304106 A1 * 10/2018 O'Leary ..... A62B 17/006

OTHER PUBLICATIONS

"Dean's Symposium on Ebola," Johns Hopkins Bloomberg School of Public Health, front page provided, Oct. 14, 2014. Retrieved: <http://www.jhsph.edu/events/2014/ebola-forum/social-media-and-multimedia-links.html>. [Cited in Specification].
"Ebola Deeply." Ebola Deeply, front page only, 2014. Retrieved: <http://www.eboladeeply.org>. [Cited in Specification].
"Ebola virus disease," World Health Organization, 2 pages, Dec. 14, 2014. Retrieved: <http://www.who.int/csr/disease/ebola/en/>. [Cited in Specification].
"Ebola." USAID. Retrieved: <http://www.usaid.gov/ebola>. [Cited in Specification].
"Ebola Response Roadmap Situation Report," World Health Organization, pp. 1-14, Dec. 10, 2014. Retrieved: <http://www.who.int/csr/disease/ebola/situation-reports/en/>. [Cited in Specification].
"MSF rejects Ebola cash asks Australia for medics," Aljazeera, pp. 1-2, Oct. 2, 2014. Retrieved: <http://www.aljazeera.com/news/africa/2014/10/msf-rej ects-ebola-cash- asks-medics-201410210414437521.html>. [Cited in Specification].
"Personal Protective Equipment." United States Department of Labor Occupational Safety & Health Administration, 2 pages, 2014. Retrieved: <https://www.osha.gov/SLTC/personalprotectiveequipment/construction.html>. [Cited in Specification].
Firger, Jessica, "What should Ebola health care workers wear?" CBS News, pp. 1-4, Oct. 17, 2014. Retrieved: <http://www.cbsnews.com/news/what-should-ebola-health-care-workers-wear/>. [Cited in Specification].
Baker, Aryn. "Why Protective Gear Is Sometimes Not Enough in the Fight Against Ebola." Time. Oct. 15, 2014. Retrieved: <http://time.com/3509980/ebola-protection-mistakes/>. [Cited in Specification].
Beaubien, Jason. "Firestone Did What Governments Have Not: Stopped Ebola in Its Tracks," National Public Radio, pp. 1-13, Oct. 6, 2014. Retrieved: <http://wwvv.npr.org/blogs/goatsandsoda/2014/10/06/354054915/firestone-did-what-governments-have-not-stopped-ebola-in-its-tracks>. [Cited in Specification].
Benton, Grace. "ICT empowers communities in fight against Ebola." eLearning Africa News. Nov. 14, 2014. Retrieved: <http://www.elearning-africa.com/eLANewsportal/ict-ebola-Sierra-Leone/>. [Cited in Specification].
Cheng, Maria. "WHO: 10,000 new Ebola cases per week could be seen." Associated Press. Oct. 14, 2014. Retrieved: <http://bigstory.ap.org/article/77bfl 13 e7b314fa7aa2ec891c2e7c7b9/who-10000-new-ebola-cases-week-could-be-seen>. [Cited in Specification].
Davis, Rebecca. "Panic in the Parking Lot: A Hospital Sees Its First Ebola Case." National Public Radio. Oct. 14, 2014. http://www.npr.org/2014/10/14/356045068/u-s-doctor-witnesses-unfolding-ebola-epidemic-at-liberian-hospital.
Kelion, L., "Ebola text-message system set to expand," BBC, pp. 1-13, Oct. 14, 2014. Retrieved: <http://www.bbc.com/news/technology-29610865>.
Martin, Kim, "HC3 Launches Ebola Communication Network to House Ebola Resources, Tools," Health Communication Capacity Collaborative, pp. 1-8, Oct. 8, 2014. Retrieved: <http://www.healthcommcapacity.org/hc3-launches-ebo la-communi cation-network-house-ebola-resources-tools/>.

(56) References Cited

OTHER PUBLICATIONS

Penfold, Erica et al., "Ebola and Cultures of Engagement: Chinese Versus Western Health Diplomacy," Council With Council of Councils, pp. 1-6, Oct. 3, 2014. Retrieved: <http://www.cfi..org/councilofcouncils/global_memos/p33560>. [Cited in Specification].
Watson, Leon, "WHO says Ebola is 'most severe acute health emergency in modem times,'"The Telegraph, pp. 1-4, Oct. 13, 2014. Retrieved: <http://www.telegraph.co.uk/news/worldnews/ebola/11158504/WHO-says-Ebola-is-mo st-severe-acute-health-emergency-in-modern-times.html>. [Cited in Specification].
"Life inside a Liberian Ebola Treatment Unit." ABC News. 2014. Retrieved: <http://abcnews.go.com/International/video/life-inside-liberian-ebola-treatment-unit-25873937>. [Cited in Specification].
"Understanding the Ebola Virus and How You Can Avoid It." Alison. 2014. Retrieved: <http://alison.com/coursesiUnderstanding-the-Ebola-Virus-and-How-You-Can-Avoid-It>. [Cited in Specification].

* cited by examiner

SUIT DESIGNS AND DOFFING METHODOLOGIES FOR PERSONAL PROTECTIVE EQUIPMENT TO PREVENT THE SPREAD OF INFECTIOUS AGENTS TO HEALTHCARE WORKERS

CROSS-REFERENCE TO PRIOR APPLICATIONS

This Application claims priority to U.S. Provisional Application No. 62/091,411, filed on Dec. 12, 2014; the entire contents of which are incorporated by reference.

BACKGROUND OF THE INVENTION

Area of the Art

The present invention relates to bodysuits for use as personal protective equipment and methods for the removal of such body suits.

Description of the Background Art

Health Care Workers (HCWs) on the front lines of the Ebola epidemic are particularly vulnerable to infection, despite the availability of various types of personal protective equipment (PPE). Effective PPE is essential to any successful disease control strategy.

Healthcare workers treating highly infectious diseases must wear a complete ensemble of personal protective equipment (PPE) to protect themselves from a range of potential contaminates that carry the infectious particle: bodily fluids, droplets, aerosols, mists, gases, or vapors. The ensemble must protect HCW during use and during doffing, or removal, without contaminating the user. The current PPE used by HCW when treating highly infectious diseases such as Lassa Fever or Ebola are pieced together using components designed for other applications. A common ensemble for HCW treating Ebola consists of a fluid resistant mask, goggles, a hood with open face area, coverall, two pairs of gloves, and rubber boots. Often, the goggles are replaced with a face shield, although this reduces the level of protection. The goggles and coverall are designed for chemical applications, and the fluid resistant mask is designed for surgery. None of the elements are designed to protect HCW from highly infectious diseases during use and during removal, resulting in a high risk of infection associated with their use.

In the fight against Ebola, Lassa Fever, and countless other medical or industrial applications, PPE is required that protects the user from exposure while meeting many use case requirements (lower heat burden, full range of motion, complete visibility, easy and safe removal). Here, features that can be integrated into PPE for improving PPE function and increasing user safety are described. These features can be combined in many configurations and may be applied to the hood, coveralls or any other portion of a PPE ensemble. Example embodiments are provided as examples below.

SUMMARY OF THE INVENTION

Current Anti-Ebola Personal Protective Equipment (PPE) poses significant risks due to the complication of donning and doffing. New concepts for a suit featuring customizable sizing, and integrated doffing and disposal methodologies to drastically reduce the complication of doffing and consequently, the risk of contamination are presented. A back-seam entry and exit is deemed to be safer than the status quo front zip suits. Several innovative seams and strategies for doffing are described. The designs described decrease the risk of contamination and reduce the number of steps and time required to doff PPE. Sizing adjustments, sweat-wicking features, and vents that can potentially be used with other cooling mechanisms can increase the comfort of the user and extend the time he or she can wear PPE. Additional features include printed instructions in the suit, tabs for ease of removal, and several innovative safety concepts. Designs described have the additional impact of improving healthcare workers' relations with the community by rendering the appearance of PPE less intimidating.

Embodiments of the invention include a bodysuit for use as a personal protective equipment item comprising: a torso portion comprising: a front side; a back side including a sealable port through which a wearer can enter and exit the bodysuit when donning or doffing the bodysuit, respectively; a waist region; a neck opening; a pair of upper limb openings; and a pair of lower limb openings; two arm portions each extending from one of the upper limb opening; and two leg portions each extending from one of the lower limb opening.

Embodiments of the invention include a bodysuit with a sealable port comprising a zipper for opening and closing said sealable port. In some embodiments this zipper includes a pull tab attached at an angle. In some embodiments the zipper is non-locking.

Embodiments of the invention include a bodysuit with a sealable port that comprises a first storm flap and a second storm flap, wherein said first storm flap overlaps with said second storm flap and wherein said first storm flap and said second storm flap form a cover over said zipper when overlapped. In some embodiments these storm flaps are embedded with a rigid material or comprise a rigid material and/or are comprise an adhesive material.

Embodiments of the invention include a bodysuit with storm flaps wherein said storm flaps comprise pull tabs. In some embodiments, these pull tabs are attached to the storm flaps at an angle between 45 and 135 degrees. In some embodiments these pull tabs are at least 10 cm or at least 20 cm in length and are removably attached to a front side of the bodysuit.

Embodiments of the invention include a bodysuit with a sealable port wherein a second layer of fabric positioned beneath said sealable port.

Embodiments of the invention include a bodysuit wherein an outer surface or a portion thereof of said bodysuit comprises a first color and wherein an inner surface or a portion thereof of said bodysuit comprises a second color.

Embodiments of the invention include a bodysuit further comprising integrated fingerless gloves disposed on said arm portions distal to said upper limb openings. In some embodiments these fingerless gloves are symmetric bands. In some embodiments, these integrated fingerless gloves are three or more symmetric bands.

Embodiments of the invention include a bodysuit comprising wrist tabs disposed on arm portions in alignment with elbow regions of a wearer when said bodysuit is worn.

Embodiments of the invention include a bodysuit comprising an elastic band positioned internally at the waist region.

Embodiments of the invention include a bodysuit comprising elastic sleeves disposed on arm portions in alignment with wrist regions of a wearer when said bodysuit is worn.

Embodiments of the invention include a bodysuit wherein lower limb openings further comprise elastic ends disposed on lower limb portions in alignment with ankle regions of a wearer when said bodysuit is worn.

Embodiments of the invention include a bodysuit comprising an integral hood attached at the neck opening, said integral hood comprising: a front side with a transparent face shield; a back side, and an opening extending from the back side of said bodysuit through the back side of the integral hood to a top end of the integral hood wherein said opening is continuous with said sealable port.

Embodiments of the invention include a bodysuit with a first and second zipper for opening and closing of an opening and sealable port, wherein said first zipper and said second zipper meet at a top end of an integral hood at a region corresponding to a crown region of a head of said wearer when said bodysuit is worn.

Embodiments of the invention include a bodysuit wherein a first storm flap comprises a first pull tab joined at a first end to said first storm flap at a region corresponding to a crown region of a head of a wearer when said bodysuit is worn and extending therefrom, and wherein said second storm flap comprises a second pull tab joined at a first end to said second storm flap at a region corresponding to a crown region of a head of a wearer when said bodysuit is worn and extending therefrom. In some embodiments these pull tabs are at least 3 cm in length.

Embodiments of the invention include a bodysuit wherein and integral hood comprises an inhalation vent and an exhalation pathway. In some embodiments, the inhalation vent is positioned on said integral hood to a region corresponding to above of a head of a wearer, a region corresponding to beside a face of a wearer, a region corresponding to an ear of a wearer, or alongside the transparent face shield, and wherein said exhalation pathway is positioned on said integral hood to a region corresponding to a mouth and nose of a wearer, beneath said transparent face shield, or a combination thereof.

Embodiments of the invention include a bodysuit comprising a second layer of fabric positioned beneath an opening and sealable port.

Embodiments of the invention include a bodysuit wherein outer surface or portion thereof of said bodysuit comprises a first color and wherein an inner surface or portion thereof of said bodysuit comprises a second color.

Embodiments of the invention include a bodysuit further comprising: wrist tabs disposed on arm portions in alignment with elbow regions of a wearer when said bodysuit is worn; and a hood tab disposed on the top end of an integral hood.

Embodiments of the invention include a bodysuit comprising an elastic band positioned internally at a waist region.

Embodiments of the invention include a bodysuit comprising elastic sleeves such that said elastic sleeves are disposed on said arm portions in alignment with wrist regions of a wearer when said bodysuit is worn.

Embodiments of the invention include a bodysuit wherein lower limb openings further comprise elastic ends disposed on said lower limb portions in alignment with ankle regions of a wearer when said bodysuit is worn.

Embodiments of the invention include a method for a wearer to remove a bodysuit used as a personal protective equipment item without assistance the method comprising the steps of: pulling a first pull tab joined at a first end to said bodysuit in a first direction away from said wearer using a first arm and simultaneously pulling a second pull tab joined at a first end to said bodysuit in a second direction and away from said wearer using a second arm such that said first direction and said second direction are opposite from each other and such that sealable port located on a backside of said bodysuit opens and such that a wearer's shoulders are exposed; withdrawing a wearer's hands from said bodysuit such that a pair of outer gloves are removed; pushing on an inner surface of said bodysuit with a wearer's hands such that said pushing results in the bodysuit being positioned below a wearer's waist; and pushing said bodysuit down with a wearer's feet such that said bodysuit is removed from a wearer's legs and feet and onto the ground surface.

Embodiments of the invention include a method for a wearer to remove a bodysuit used as a personal protective equipment item without assistance the method comprising the steps of: pulling a first pull tab joined at a first end to an integral hood of said bodysuit in a first direction away from said wearer using a first arm and simultaneously pulling a second pull tab joined at a first end to said integral hood of said bodysuit in a second direction and away from said wearer using a second arm such that said first direction and said second direction are opposite from each other and such that an opening extending from a back side of said bodysuit through a back side of said integral hood to a top end of the integral hood wherein said opening is continuous with a sealable port on the back side of said bodysuit opens at the top end of said integral hood and such that said integral hood is pulled over a wearer's head and such that said integral hood is allowed to hang in front of said wearer's head; withdrawing a wearer's hands from said bodysuit such that a pair of outer gloves are removed; pushing on an inner surface of said bodysuit with a wearer's hands such that said pushing results in the bodysuit being positioned below a wearer's waist; and pushing said bodysuit down with a wearer's feet such that said bodysuit is removed from a wearer's legs and feet and onto the ground surface.

Embodiments of the invention include a method for a wearer to remove a bodysuit used as a personal protective equipment item without assistance the method comprising the steps of: pulling a first pull tab joined at a first end to said bodysuit in a first direction away from said wearer using a first arm and simultaneously pulling a second pull tab joined at a first end to said bodysuit in a second direction and away from said wearer using a second arm such that said first direction and said second direction are opposite from each other and such that sealable port located on a backside of said bodysuit opens; bending down such that wrist tabs attached to arm portions of said bodysuit at regions corresponding to wrist portions of said wearer are positioned on a ground surface; stepping on said wrist tabs; pushing with legs so as said wearer adopts a standing position and such that said sealable port opens and said arm portions and a torso portion of said bodysuit invert as they are pulled off; and pushing said bodysuit down with a wearer's feet such that said bodysuit is removed from a wearer's legs and feet and onto the ground surface.

Embodiments of the invention include a method for a wearer to remove a bodysuit used as a personal protective equipment item without assistance the method comprising the steps of: pulling a first pull tab joined at a first end to an integral hood of said bodysuit in a first direction away from said wearer using a first arm and simultaneously pulling a second pull tab joined at a first end to said integral hood of said bodysuit in a second direction and away from said wearer using a second arm such that said first direction and said second direction are opposite from each other and such that an opening extending from a back side of said bodysuit through a back side of said integral hood to a top end of the integral hood wherein said opening is continuous with a sealable port on the back side of said bodysuit opens at the top end of said integral hood and such that said integral hood is pulled over a wearer's head and such that said integral hood is allowed to hang in front of said wearer's head; bending down such that said wrist tabs attached to arm portions of said bodysuit at regions corresponding to wrist portions of said wearer are positioned on a ground surface; stepping on said wrist tabs; pushing with legs so as said wearer adopts a standing position and such that said opening extending from the back side of said bodysuit through the back side of said integral hood to the top end of said integral hood wherein said opening is continuous with said sealable port opens and said arm portions and a torso portion of said bodysuit invert as they are pulled off; and pushing said bodysuit down with a wearer's feet such that the bodysuit is removed from a wearer's legs and feet and onto the ground surface.

Further objectives and advantages, as well as the structure and function of preferred embodiments will become apparent from a consideration of the description, and non-limiting examples that follow.

DETAILED DESCRIPTION OF THE INVENTION

Figure 1:
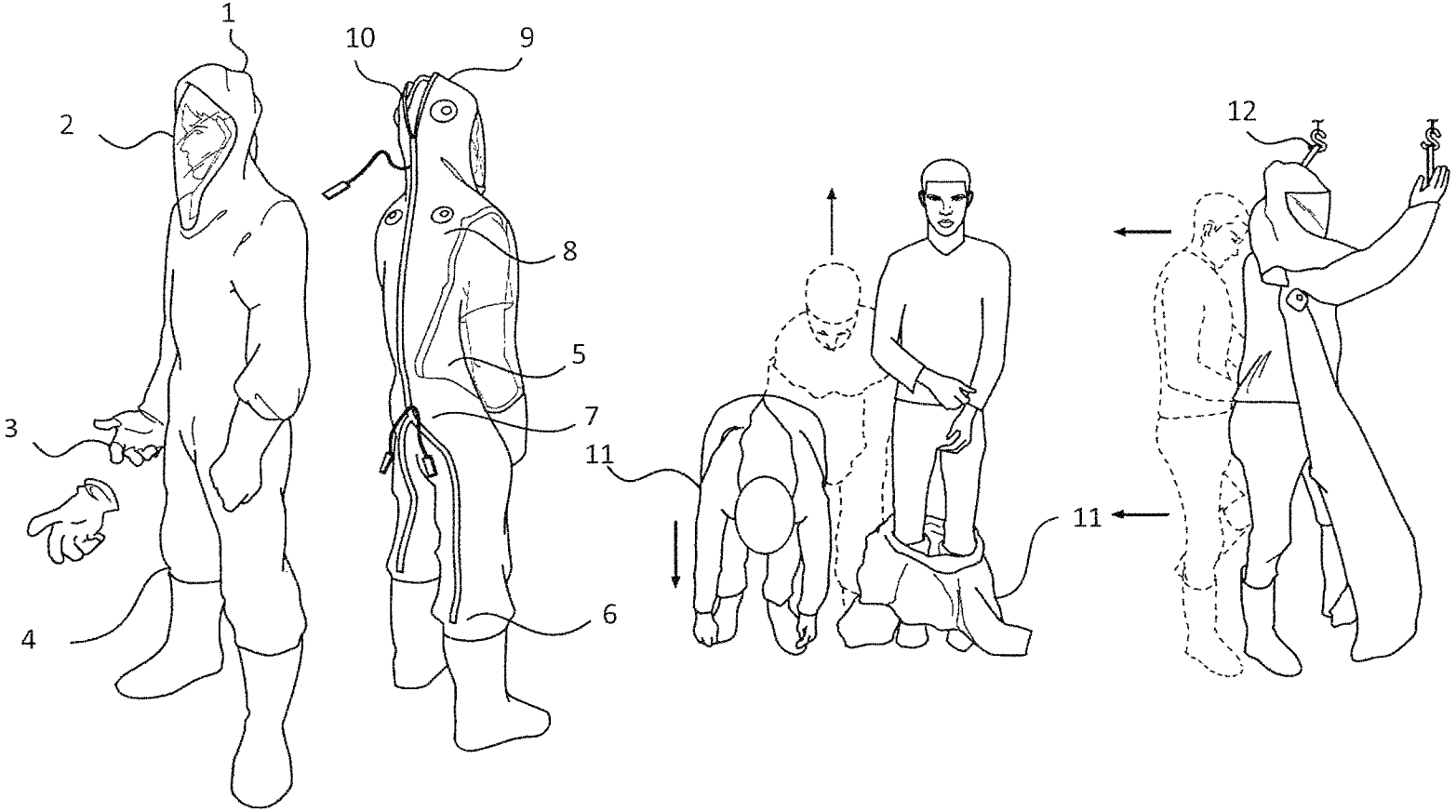
FIG. 1 shows a rendering of Comprehensive Anti-Ebola PPE design improvements.

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

Current Anti-Ebola Personal Protective Equipment (PPE) poses significant risks due to the complication of donning and doffing. Here, new concepts for a suit featuring customizable sizing, and integrated doffing and disposal methodologies to drastically reduce the complication of doffing and consequently, the risk of contamination are presented. A back-seam entry and exit is deemed to be safer than the status quo front zip suits. Several innovative seams and strategies for doffing are described. The designs described decrease the risk of contamination and reduce the number of steps and time required to doff PPE. Sizing adjustments, sweat-wicking features, and vents that can potentially be used with other cooling mechanisms can increase the comfort of the user and extend the time he or she can wear PPE. Additional features include printed instructions in the suit, tabs for ease of removal, and several innovative safety concepts. Designs described have the additional impact of improving healthcare workers' relations with the community by rendering the appearance of PPE less intimidating.

Examples described below include and bodysuit wherein the entry and exit seam is moved to the back of the suit and hood where there is less contamination.

Examples described below include adjustable sizing achieved by drawstring or elastic, fitted internally with high-waist pants for improved comfort and reduced risk of tripping or splashing.

Examples described below include a parallel zipper to Ziploc design covered with a Velcro tab allows for single entry and single break-away exit.

Examples described below include a break-away zipper that ensures seal integrity while in use, then is converted with a pull-tab into a rapid release break-away seam.

Examples described below include added rigidity alongside a zipper to improve ease of doffing without an assistant.

Examples described below include added rigidity alongside zipper with curled treatment so as to facilitate a curl-away motion of the garment while doffing to encase contamination, and to prevent inadvertent contamination of inner scrubs while doffing.

Examples described below include a low profile fingerless glove liner integrated into the arms of the coveralls to ensure the external gloves easily come off with the suit during the doffing process.

Examples described below include a larger face shield and transparent hood to decrease patient apprehension and increase HCW visibility.

Examples described below include an integrated hood including the face covering creates seamless, impermeable barrier to cover face, and is removed in one step along with the rest of the suit. Strategically placed scratch pads along the interior of the face hood that allow for sweat wicking and scratching of the eyebrows by the health workers.

Examples described below include strategically placed vents to decrease fogging by pulling less saturated air in from the environment over the inside of the visor when the user inhales; as the user exhales, the air is directed out the bottom of the hood using the same one way valves used in standard N95 respirator masks. This keeps the hot moist air away from the visor.

Examples described below include high surface area vents, much greater than that of a simple mask, decrease the resistance to breathing.

Examples described below include doffing instructions and appropriate contact points printed and highlighted on the suit with color-coding and graphics. Example: inside is a different color than the outside to clearly indicate where to touch the suit while performing the doffing procedure.

Examples described below include a layer of fabric beneath the exit seam to provide a second layer of protection against contamination while doffing.

Examples described below include a reusable high performance moisture wicking base layer to replace scrubs and provide dry skin, wicking and evaporative cooling when exposed to air flow inside suit and once outer PPE is doffed.

Examples described below include a colored interior layer of the suit that allows for quick identification of breaches.

Examples described below include doffing tabs placed on sleeves, gloves and hood to permit rapid safe doffing of suit.

Examples described below include a baffle of clean fabric built into the zipper to catch possible contamination on the back of the health care worker.

Examples described below include a hook-in doffing method to allow for safe removal of the suit without an assistant.

Examples described below include a "cocoon" doffing method to provide built-in disposal of the contaminated suit.

Example 1

FIG. 1 shows a rendering of Comprehensive Anti-Ebola PPE design improvements. The suit in FIG. 1 has: 1, an integrated hood and shield with more continuous coverage and fewer components to doff; 2, a large clear area on the hood with improved visibility and where more of the user's face is visible for a less intimidating appearance; 3, fingerless glove liners integrated into the suit for easier removal of outer gloves; 4, baffles at openings where extra material under the seams adds a second layer of protection; 5, a wicking inner layer worn under the suit with additional passive cooling and improved comfort; 6, breakaway leg seams with tabs that rip the legs open in the back of the suit to allow the user to easily step out of suit; 7, a rear zipper with long pull tabs that provide suit openings in a low-contamination area, for fewer leaks and contact when doffing and where long tabs allow unzipping without assistance; 8, an integrated cooling/connection port for an external air source for cooling the skin of a wearer and reducing fogging; 9, a curl away zipper where ribbing causes the fabric to curl outwards, concealing contaminate edges; 10, a colored suit interior so as to clearly differentiate what areas are clean and can be safely touched.

FIG. 1 also depicts doffing methods. In 11, the suit contains Velcro wrist tabs and the user sticks down or stands on the tabs, then stands up to doff the suit. In 12, the suit contains optional hood and wrist hooks so that the user can hook the hooks onto overhead carabineers which hold the suit for removal without assistance.

A comprehensive single-entry suit reduces potential contamination and simplifies the donning and doffing process for health care workers. Innovative concepts for the integrated full body Anti-Ebola PPE include: Doffing instructions printed in the suit to facilitate safer, standardized processes. Sections of the exterior of the suit can be printed with recognizable community patterns to improve community relations. An integrated disposal bag within the suit ultimately encases contaminated material as the wearer steps out. Tab attachments at wrists attach to legs and provide tension for removing the front of the suit. Integrated footwear protects healthcare worker from contamination due to puncture on foot of suit.

Sizing Modifications

Some embodiments of the invention embody several novel features for garment sizing to improve one-size-fits-all aspect of the PPE suit described herein.

Figure 2:
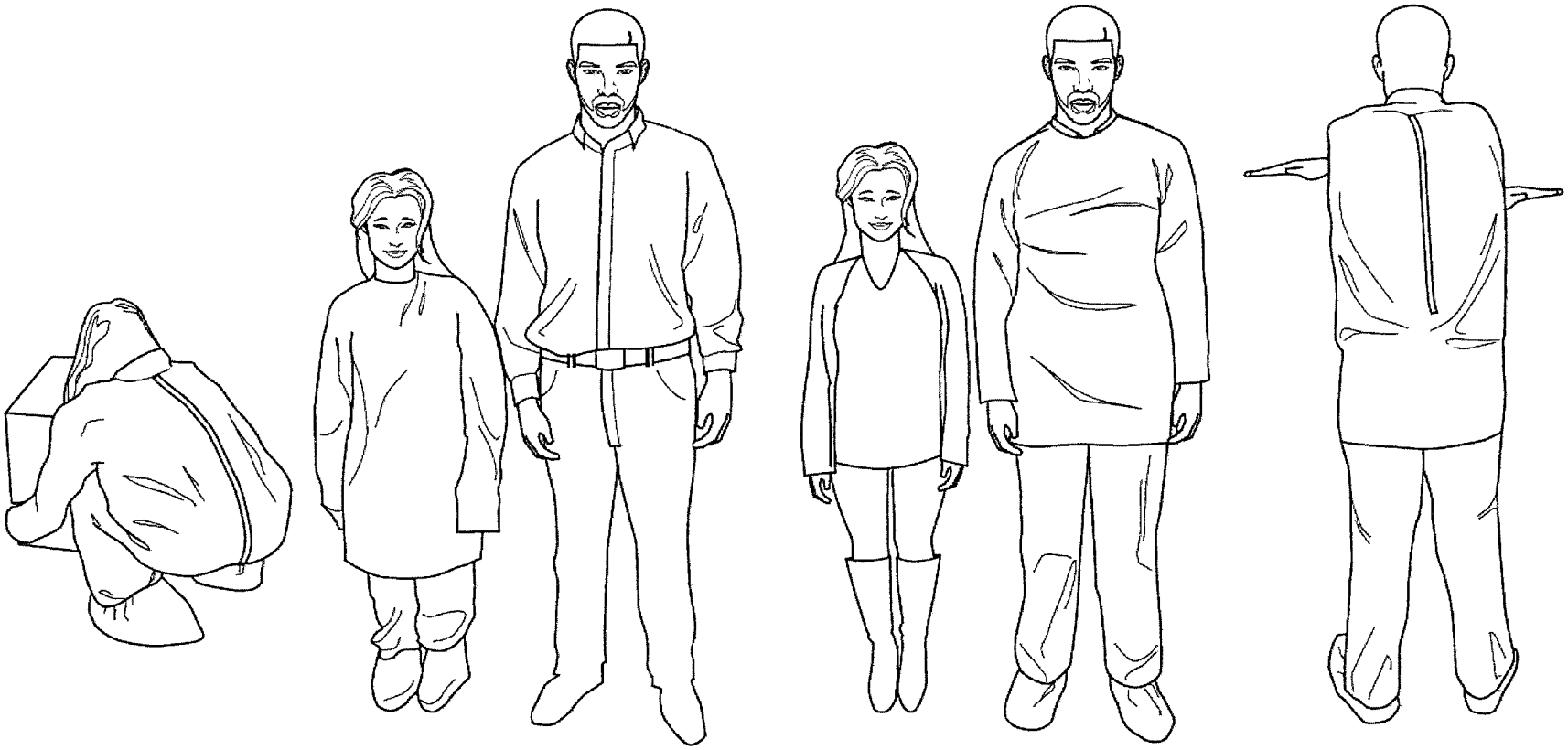
FIG. 2 is a panel showing a prototype of a one-size-fits-all PPE suit that utilizes interior drawstring for sizing; Models are 5' and 6'4.

FIG. 2 is a panel showing a prototype of a one-size-fits-all PPE suit that utilizes interior drawstring for sizing; Models are 5' and 6'4.

By adding in an elasticized drawstring to the waist of the suit, which is fastened from the inside when the wearer dons the suit, healthcare workers of any size can fit in the suit. For shorter healthcare workers, the drawstring is tied high on the waist and the extra length folds over as a tunic. For taller healthcare workers, the drawstring sits lower on the waist. Additional elastic or adhesive fold-tabs along arms and legs will improve adjustable sizing.

Back Seam Closures

The suit comprises back seam closures. These can be preferred to front seams due to the risk of contamination during doffing of traditional suits which have front seams. The hands and the front of the suit become more contaminated during patient care, and every effort should be made to keep contaminated gloves away from the face of the healthcare worker during doffing. This is impossible with the existing front-zipper PPE. Back entry and exit provide more protection against contamination. Several examples of back seam closures are described.

Figure 3:
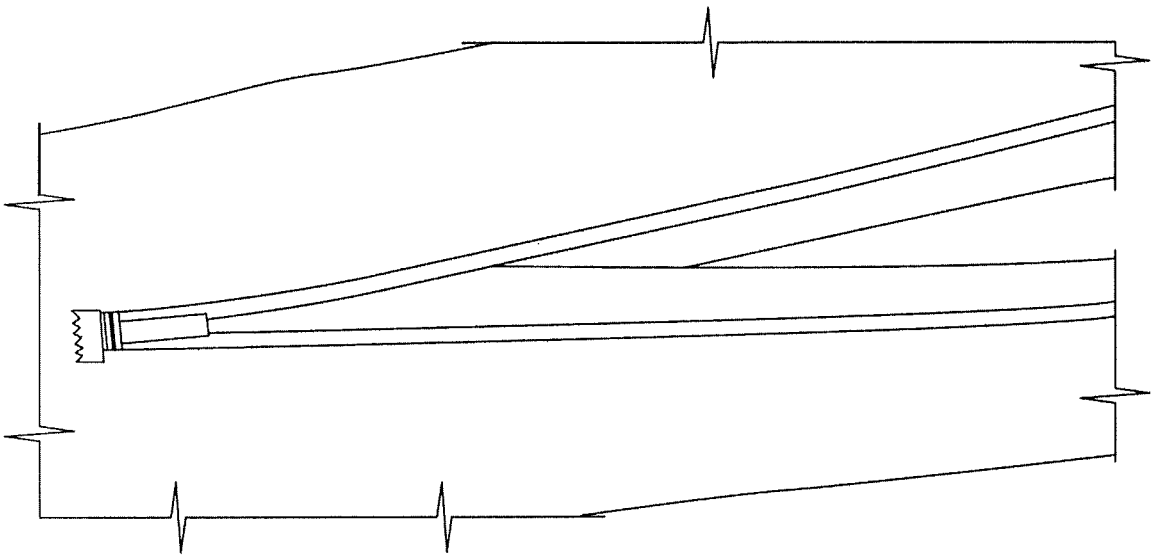
FIG. 3 shows a rigid zipper.

A stiff collar and zipper pull allows for easier donning and doffing without an assistant. This is achieved by using boning or various rigid trimmings alongside or directly attached to the zipper closure. A heat-curled boning can facilitate the curl-away movement of the suit so that contamination is encased. Curl-zip innovation helps to outwardly peel suit away from body to encase contaminated fluids. Such a zipper is shown in FIG. 3. FIG. 3 shows a rigid zipper.

The suit also comprises a parallel single-entry zipper and single exit Ziploc design that makes for very quick doffing. The Ziploc seal for easy doffing is installed within a pleat and therefore is protected from pressure that may cause unwanted opening. An additional close-tab of Velcro or adhesive can attach at strategic pressure points to provide additional protection to areas, such as the neck.

The suit also comprises a back seam with a pull-tab method, which allows for quick break-away of the pants. Pull strings are installed and sealed in by foil or other waterproof airtight, impermeable tape, which can only be broken with the deliberate pull of the string, demonstrated in the following section.

An integrated baffle of clean Tyvek that is built in under the exit seam can be utilized with any suit design to catch potential contamination on the HCW's back.

Hook Doffing Methodology and Integrated Doffing Station

Examples of the invention comprise a new system for doffing contaminated Anti-Ebola Personal Protective Equipment including a novel suit and doffing station. Novel features include an integrated hood and suit with a head-to waist zip-back entry and exit to simplify donning and doffing process. Loop tabs on the hood and wrists allows self-doffing by attaching to hooks. The hook-in doffing station can be integrated with suggested chlorine showers, which are part of existing safe-doffing protocol in the field.

FIG. 4 is a storyboard depicting the quick removal of one-piece suit using a hook-doffing method. In FIG. 4, from left to right and top to bottom: the wearer walks into a shower of 0.05% chlorine to disinfect as much as possible before the doffing process; then the user removes the galoshes using a boot jack; then the user steps into a large biohazard disposal bag; then the user hooks the loop at the head of the suit to a disposable carabineer on a pole; then the user removes the first layer of gloves and drops them into the biohazard bag; then the user rubs chlorine on the second pair of gloves using a wipe box built into the sleeve of the suit; then the user unzips the suit from the head to the waist regions of the suit using textured tabs to differentiate the zipper pull tab; then the user pulls a tab from the waist to the ankle regions of the suit; then the user hooks the loops located at the wrist regions of the suit into disposable carabineers; then the user pulls his/her arms through the inside of the sleeves of the suit; then the user steps out of the bag; then the user lifts the bag to cover the suit; then the user uses the inside of the bag to remove the disposable carabineers; then the user drops the carabineers into the bag; then the user ties or seals the bad and removes it to a hazardous waste area.

Figure 4A:
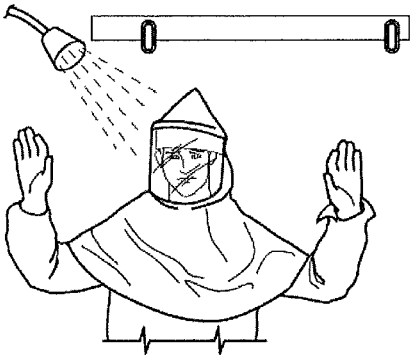
FIG. 4A shows a wearer in a suit being sprayed down prior to removal of the suit.
Figure 4B:
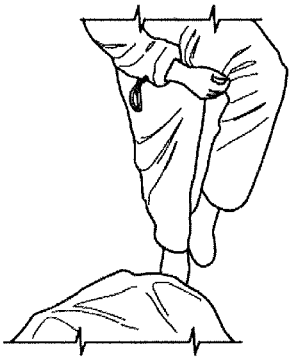
FIG. 4B shows a wearer removing galoshes using a boot jack.
Figure 4C:
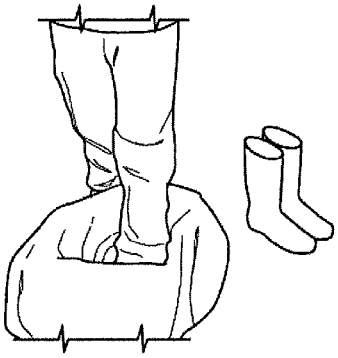
FIG. 4C shows a wearer stepping into a biohazard bag.
Figure 4D:
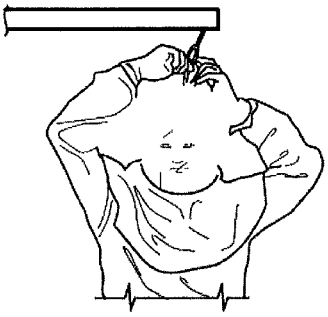
FIG. 4D shows the wearer hooking the hook loop at head of the suit to a disposable carabineer.
Figure 4E:
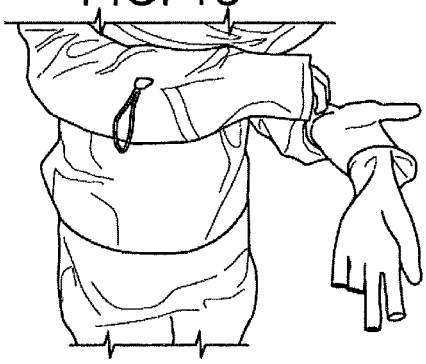
FIG. 4E shows a wearer taking off first layer of gloves and dropping the gloves into the bag.
Figure 4F:
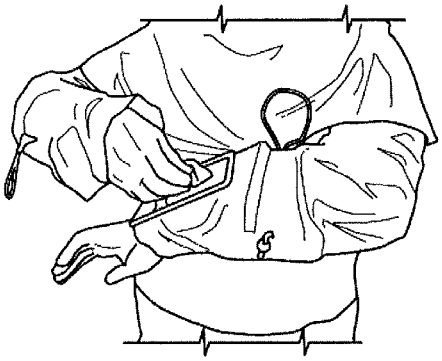
FIG. 4F shows a wearer rubbing chlorine on a second pair of gloves from a built-in wipe box sleeve.
Figure 4G:
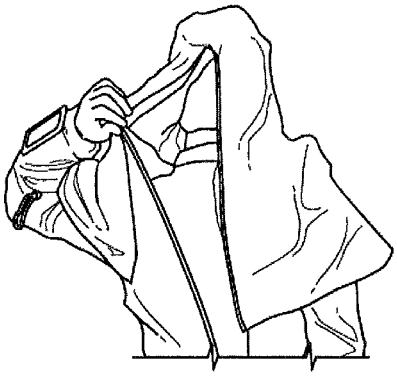
FIG. 4G shows a wearer unzipping the suit from head to waist, using textured tabs to differentiate zipper pull tab.
Figure 4H:
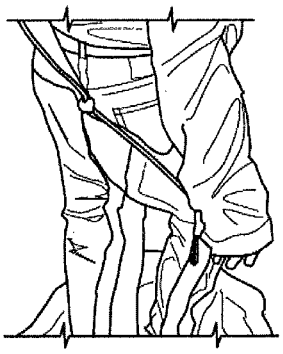
FIG. 4H shows a wearer pulling a tab from waist to ankle.
Figure 4I:
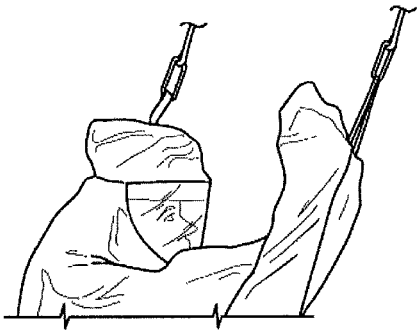
FIG. 4I shows a wearer hooking wrist loops into disposable carabineer.
Figure 4J:
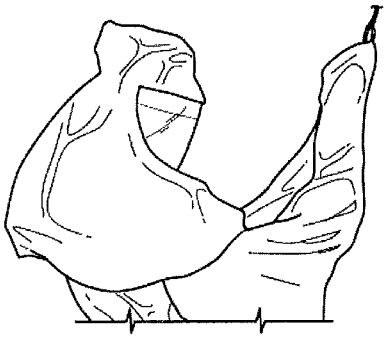
FIG. 4J shows a wearer pulling arms through the inside of the sleeves.
Figure 4K:
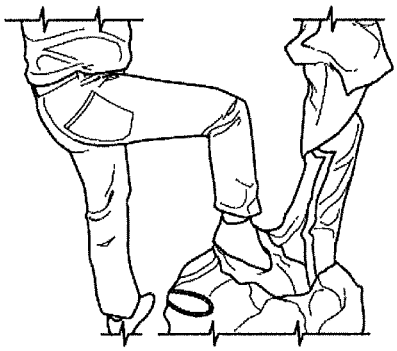
FIG. 4K shows a wearer stepping out of the bag.
Figure 4L:
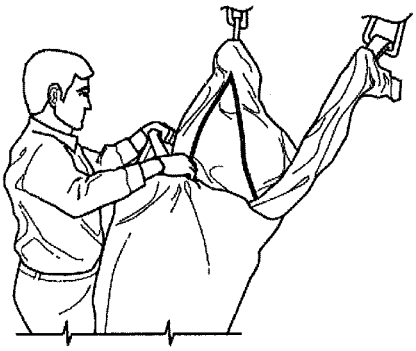
FIG. 4L shows a wearer lifting the bag to cover the suit.
Figure 4M:
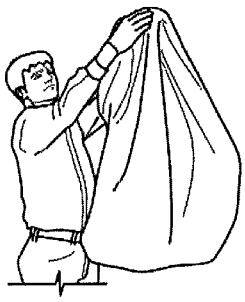
FIG. 4M shows a wearer using the inside of the bag to remove the disposable carabineers.
Figure 4N:
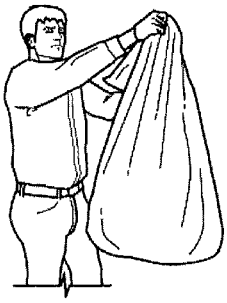
FIG. 4N shows a wearer dropping the carabineers into the bag.
Figure 4O:
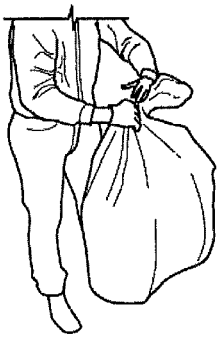
FIG. 4O shows a wearer sealing the bag and removing it to a hazardous waste area.

FIG. 4A shows a wearer in a suit being sprayed down prior to removal of the suit; FIG. 4B shows a wearer removing galoshes using a boot jack; FIG. 4C shows a wearer stepping into a biohazard bag; FIG. 4D shows the wearer hooking the hook loop at head of the suit to a disposable carabineer; FIG. 4E shows a wearer taking off first layer of gloves and dropping the gloves into the bag; FIG. 4F shows a wearer rubbing chlorine on a second pair of gloves from a built-in wipe box sleeve; FIG. 4G shows a wearer unzipping the suit from head to waist, using textured tabs to differentiate zipper pull tab; FIG. 4H shows a wearer pulling a tab from waist to ankle; FIG. 4I shows a wearer hooking wrist loops into disposable carabineer; FIG. 4J shows a wearer pulling arms through the inside of the sleeves; FIG. 4K shows a wearer stepping out of the bag; FIG. 4L shows a wearer lifting the bag to cover the suit; FIG. 4M shows a wearer using the inside of the bag to remove the disposable carabineers; FIG. 4N shows a wearer dropping the carabineers into the bag; FIG. 4O shows a wearer sealing the bag and removing it to a hazardous waste area.

The hook doffing methodology and doffing station feature several innovations on the suit, including pockets for disinfectant wipes and pull-tab method of PPE doffing. An additional innovation is a single-ear stethoscope attachment that sits inside the suit, which cannot be attained with existing PPE (not pictured). An integrated stethoscope mechanism for Anti-Ebola Personal Protective Equipment can reduce contamination passed on medical equipment and improve ease of treatment in the field. The stethoscope design can be installed in the interior of any Anti-Ebola Personal Protective Equipment suit. The stethoscope membrane is attached at wrist inside suit down the interior of the arm. The healthcare worker can turn off the stethoscope mechanism using a locking valve.

"Cocoon" Doffing Method

Current doffing requires 20-30 steps, and an assistant must physically aid the PPE wearer during the doffing process. Some embodiments of the invention comprise a "cocoon" method that works with an integrated baffle and bag. The method reduces the steps and time required for doffing, improves safety, and can be performed without assistance. The concept can be seen in FIG. 1.

Steps include:

1) Disconnecting the tabs from the elbows of the suit (these are permanently attached to the wrists of the suit) and pull zipper "breakaway" release tab (the zipper is secure until the breakaway tab is pulled)

2) Grabbing the top of the integrated hood, pull forward and down over the head, allowing it to hang in front. (The zipper in back of hood will break part and separate, and the inner liner underneath the zipper will add protection)

3) Bending down, placing tabs on floor and step on the tabs

4) Pushing with legs to stand up. (Zipper in back of suit will continue to break apart and the inner liner will add protection while the seam separates. Sleeves will invert as they pull off, pulling off the outer gloves easily due to the fingerless glove liner. The inner layer of gloves remains in place. The torso of the suit inverts and falls to mid-thigh).

5) Lifting feet out of the legs of the suit when pushing suit down off of feet onto floor.

6) Wiping inner glove with chlorine wipes

7) Removing boots

Figure 5:
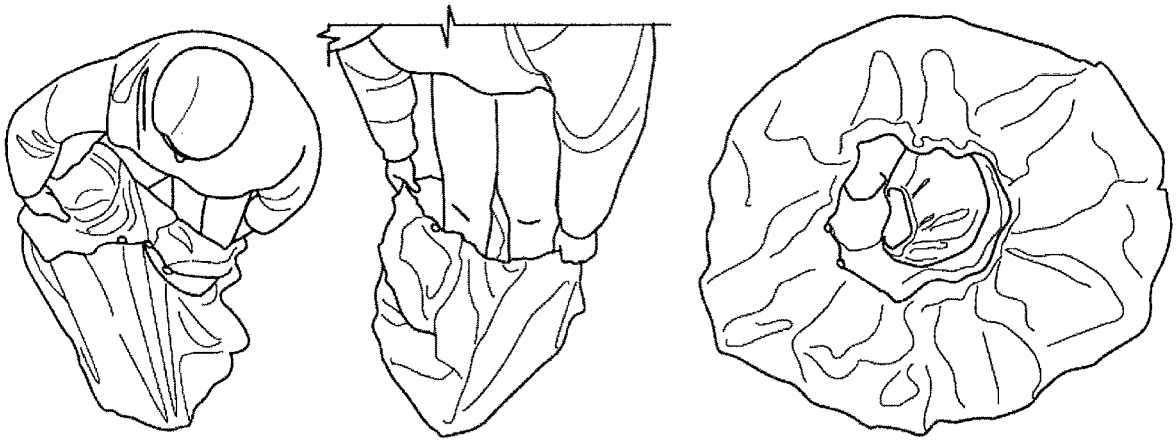
FIG. 5 shows a prototype of an integrated disposal bag.

An elastic bag has been attached to the inside of the suit to facilitate with disposal. The bag is attached halfway down the suit so that once the wearer's arms are out of the suit they can access the bag and step into the bag. Once the PPE suit is around the ankle and the wearer is standing in the bag, they can step out of the suit within the bag. After the suit is completely off, the wearer can then step out of the bag and pick up their bag with contaminated suit inside. FIG. 5 depicts a prototype of an integrated disposal bag.

Further doffing strategies described herein include the use of a bootjack to doff the boots with no hands. Otherwise, integrated foot protection in the form of reinforcement on the soles of the PPE suit can cover the shoes or galoshes worn by health care workers.

Hood Designs with Back Removal, Improved Ventilation, and Improved Visibility

The suit can have an integrated hood or a detachable hood or other components for a user's head. Here, several options for a hood that can be attached to a suit are described. A component for safe doffing not previously recognized in the field is the breakaway at the rear of the suit. As such, an improvement is the integration of a back zipper on the hood so that the hood does not need to be doffed by lifting it overhead. Transparent hood designs removes intimidation factor by showing the human face within the suit to improve community and patient relations. Passive air supply is made available by filter on the back of the head or through respirator.

Figure 6:
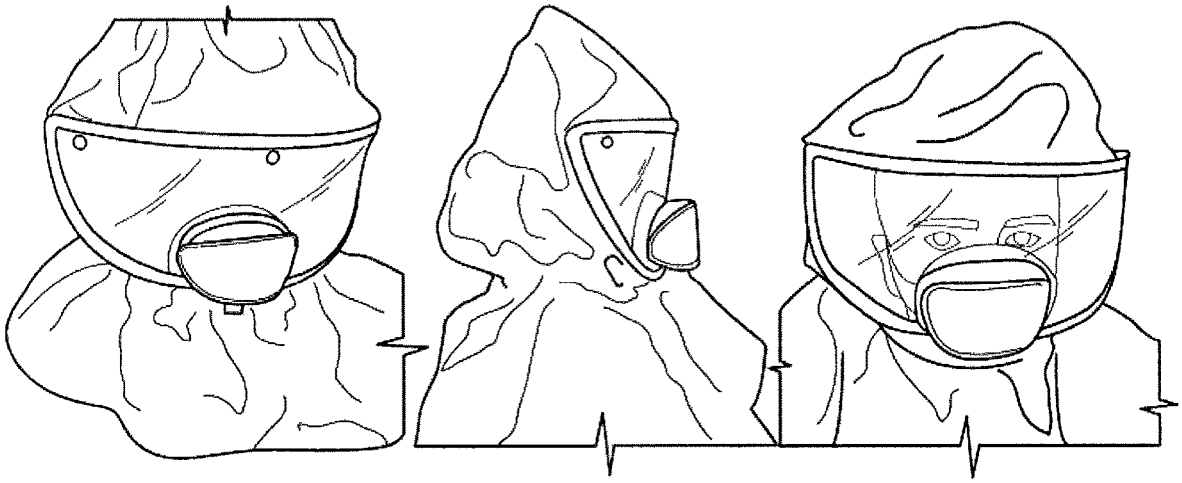
FIG. 6 shows a hood design with a wide face screen with Integrated Respirator with internal elastic fittings.

FIG. 6 shows a hood design with a wide face screen with Integrated Respirator with internal elastic fittings.

An innovative and low-cost head covering which features 360-degree visibility and breathable backing is also described herein. This head covering addresses long-standing challenges of visibility, ventilation, and risk of contamination for health care workers dealing with the Ebola crisis.

Innovative fabrication method drastically reduces costs of manufacturing and shipment. Current semi-open face shields are vulnerable to sideways and upward splash contamination; therefore a 360-degree design will improve safety.

Figure 7:
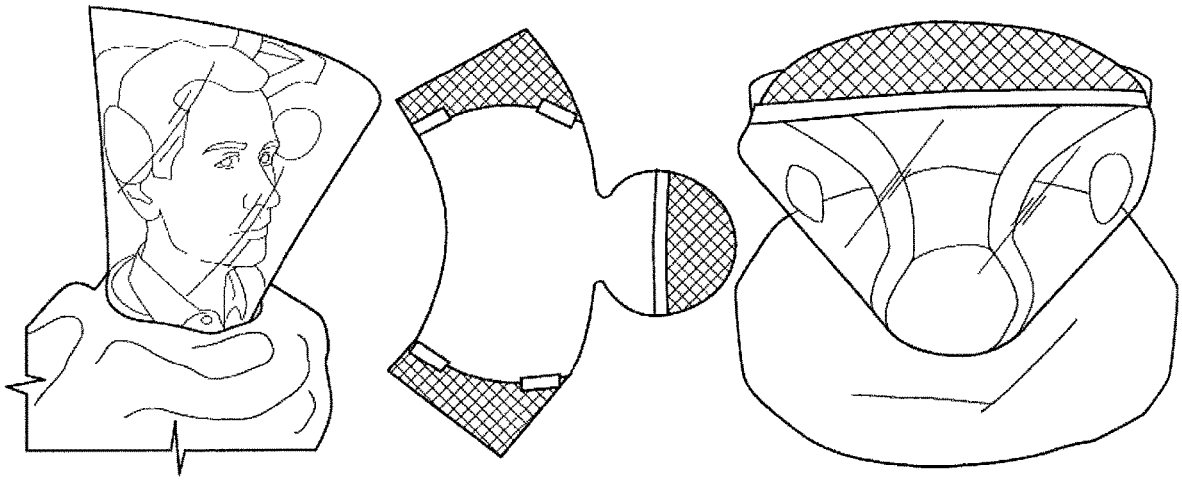
FIG. 7 shows an example of breathable, transparent, flat-manufacture Anti-Ebola Personal Protective Equipment head covering for maximum visibility and low cost.

FIG. 7 shows an example of breathable, transparent, flat-manufacture Anti-Ebola Personal Protective Equipment head covering for maximum visibility and low cost.

Cone-roll fabrication of semi-rigid acetate and adhesive or Velcro closures makes for cheap, lay-flat production and shipment. Increased visibility improves safety and reduces intimidating appearance of healthcare worker. Ventilated back of headgear reduces fogging and removes need for powered ventilation system. Additional sweat absorbent pads inside visor increase comfort for healthcare worker. An additional concept of a bib flap that drops down during doffing to cover contamination can be affixed to any hood design.

Barrier Method

Current Anti-Ebola Personal Protective Equipment focuses on the waterproof total encasement of the healthcare worker's body. One potential alternative described herein is an anti-contamination methodology that uses a plastic screen as a barrier between patient and healthcare that can be used in combination with full PPE or reduced levels of PPE.

Figure 8:
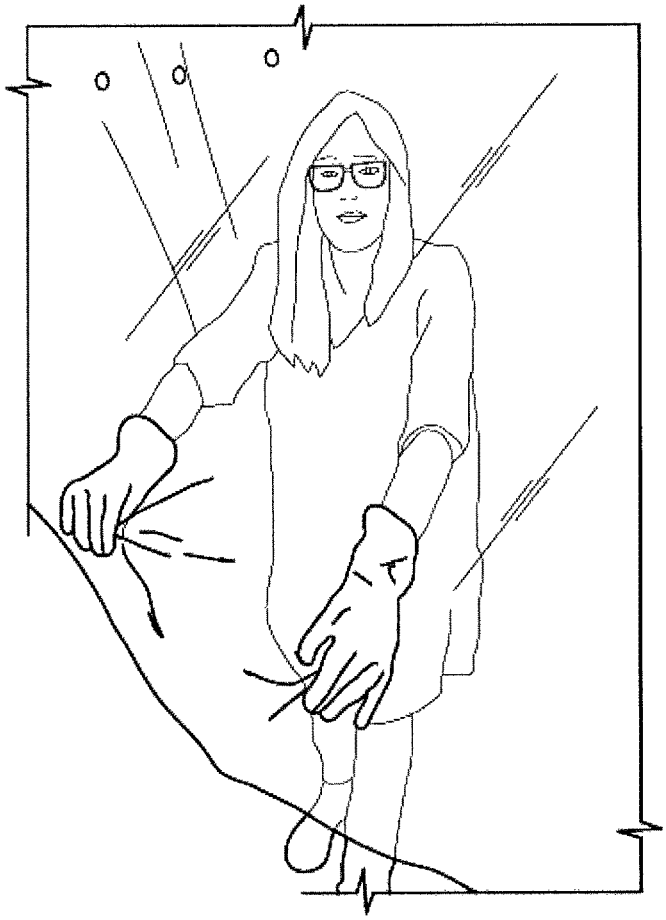
FIG. 8 shows a prototype of double-glove screen barrier methodology for patient care to contain contamination.

FIG. 8 shows a prototype of double-glove screen barrier methodology for patient care to contain contamination.

The barrier screen includes integrated outer layer gloves and can be reused and used with fewer layers of gloves on the body of the health care worker, thus potentially lowering costs, and simplifying the safety procedures for Personal Protective Equipment doffing. Barrier can be draped over a frame to "tent" the patient within Encasement of the patient as opposed to the healthcare worker will allow for reusable first-layer protection between patient and provider, reducing the complication of the current PPE methodology. This barrier may also make patient access by family members more assessable by potentially removing the need for full PPE donning before entering patient care area.

Conclusion:

Taken in part or all together, embodiments described herein for improved integrated PPE and doffing strategies can drastically improve ease of use and reduce risk of contamination during doffing. The embodiments described herein satisfy long-felt needs in the market and may be attainable at low costs.

Example 2

The following example describes a body suit with all possible features as they would apply to a collared coverall, which is a full body suit that covers the torso, arms, and legs, but does not cover the head. They can also apply to a hooded coverall, or a suit that covers the torso, arms, legs, and head. The coveralls may include integrated booties to cover the feet of the user. Additionally, the features are not dependent on one another, and can be implemented in many different combinations.

The features improve usability of the suit or simplify the doffing procedure.

One embodiment of the invention includes a collared coverall with a front seam for putting on the suit and taking off the suit if no contamination is present. It includes a rear exit seam for removing the suit after exposure to contamination. Pull tabs that attach to the rear seam to open it easily and cleanly, and flaps that enable the user to quickly remove the suit. The sleeve ends have attached finger loops to keep the sleeve in place on the user's arm. Loops underneath the pant leg loop underneath the boot of the user to keep the leg in place during use.

Front Entry Options

Closure methods include: a standard zipper with adhesive 'storm flap'; a double channel seam with slider (Ziploc) possibly with some method of reinforcing; and a dry bag closure (flap folded over several times kept close with detachable method i.e. Velcro)

The location of a front entry seam can be: at the center of suit; offset from center, meeting the hip bone of the user at bottom and side of neck.

A rear exit seam can have the following properties: a Zipper with non-locking slider, wide adhesive storm flap; semi-rigid members within the storm flaps to encourage them to move away from the body, where these semi rigid members can be trained to curl outward to encase contamination and prevent inadvertent contact between the undergarments and the outer surface of the suit during doffing and may be applied using adhesive, sewn in place, or captured by material; separate color on the interior surface of the storm flap to indicate to the user the sections of suit that is not contaminated; separate, more permeable material on the inner surface so that it does not add to the heat burden and weight of the suit; a baffle, or second layer of material beneath the exit seam to provide an additional layer of protection against contamination while doffing, where the baffle may be made of a more permeable material so that it does not contribute to the heat burden while still providing sufficient protection from low level, short duration exposure.

Methods for opening the seams can include: pull tabs attached to end of zipper at extra material that extends above the collar, tabs pass around neck and over shoulders, where the user pulls right tab with right arm laterally to the right; and/or pull tabs pass from middle of back around shoulders, using shoulders as redirection point. User pulls with right arm from left shoulder across body to the right.

Doffing methods include the following steps: a user steps on pieces of the suit to remove other parts, for example stepping on an extension of the hood to apply tension to the rest of the suit to pull it from the body easily without grabbing and stepping on flaps attached to sections of the suit that allow the user to apply a large amount of force at the correct direction.

The suit can also be doffed using a hooking method, where a user hooks loops on the suit onto an external structure and the user attaches separate and distant parts of the suit to itself as an anchor, then the user moves his/her body away from this anchor to doff the suit.

The user can also attach a piece of fabric from the mid-forearm to the knees of the suit by bending over. Stand up to apply tension to the fabric flaps. This tension pulls the suit to change its position as part of the doffing process.

Sleeve ends of the suit keep the sleeve in place during use, ensuring that it does not ride up on the arm of the user and leave skin of the wrist exposed. In addition, they capture the outer glove and remove it along with the suit during doffing. Features of the sleeve ends include: a low profile fingerless glove, or glove with partial fingers made of a material that can expand significantly to accommodate many differently sized individuals; two members of material that pass over either side of the middle finger and attach to the midpoint of the inner wrist; thumb loop that connects from edges of material; a thumb loop similar to that used in athletic wear; a net of fabric or another material that allows users to position their fingers in multiple ways; and/or a mitten with overlapping slots in end to create holes in fabric large enough to easily pass a finger through.

To address sizing issues, the suit can have extra material folded over itself that can be expanded if needed. The user inserts his/her arm and the material extends to the length that is required. This can apply to the arms, legs, torso, and other areas that are difficult to size. The suit can also have a self-adhesive material lining the inside of the garment. After donning the suit normally, the user can press the large gaps and take up much of the excess material so that it is not free to move around and snag on objects during use The pant legs of the suit can have a loop that sits underneath boot (stirrups); integrated booties with reinforced base; sizing adjustments (see above) to keep ankle region at ankle of the user.

Other features of the suit include: different interior and exterior color to indicate to the user the clean and potentially contaminated surfaces of the suit; doffing instructions and appropriate contact points printed on the suit with color coding and graphics to guide the user during donning and doffing; highlighted risk points visible if the suit is donned incorrectly or if the suit is disturbed during use, such highlighted risk points include bright colored line underneath adhesive on bottom side of storm flap and/or sections of the wrist region which warn users when the sleeve is about to be exposed; more permeable material for large collar region that is covered by the hood to decrease the heat burden associated with two layers of material; colored second layer of the suit that allows for quick identification of breaches where the color is easily seen if a breach occurs; the exterior of the suit can be printed with recognizable community patterns to improve community relations and community perception of the HCW; integrated disposal bag within the suit ultimately encases contaminated material as the wearer doffs; integrated wrist stethoscope with a replaceable membrane with an adhesive coating that attaches to the interior of the suit, the communication line then passes up into the hood of the suit into the user and the earpiece is positioned near the ear, and can be pushed into position from outside the suit; integrated pocket for disinfectant wipes keep sanitation; magnetic fogging reduction; and/or integrated sweat pads on the inside of the shield allow users to dab their sweat.

Example 3

Improved Coverall

The Improved Coverall is a rear-entry coverall designed to decrease the time and difficulty of doffing PPE.

Figure 9:
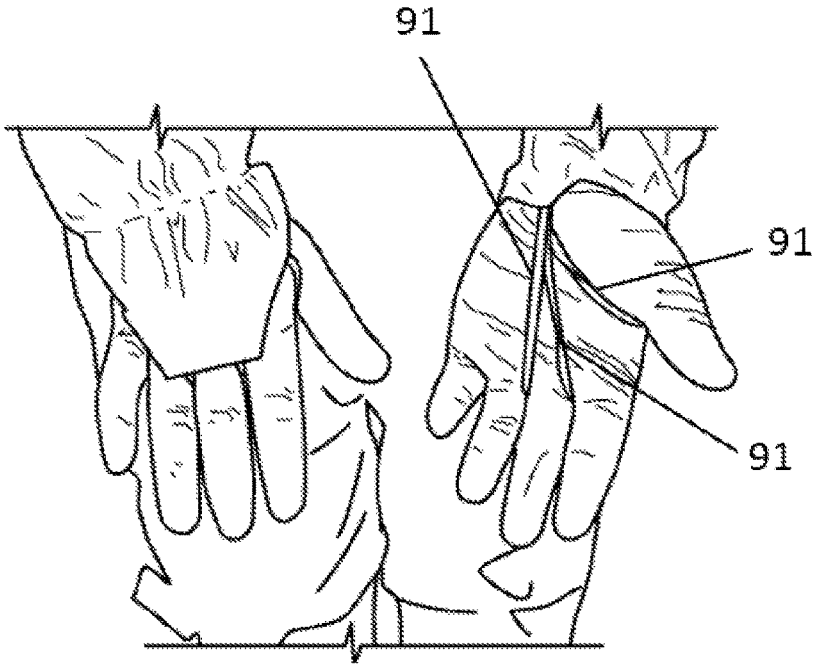
FIG. 9 shows a picture of the fingerless gloves with an elastic band passing through the fingers of a user.
Figure 10:
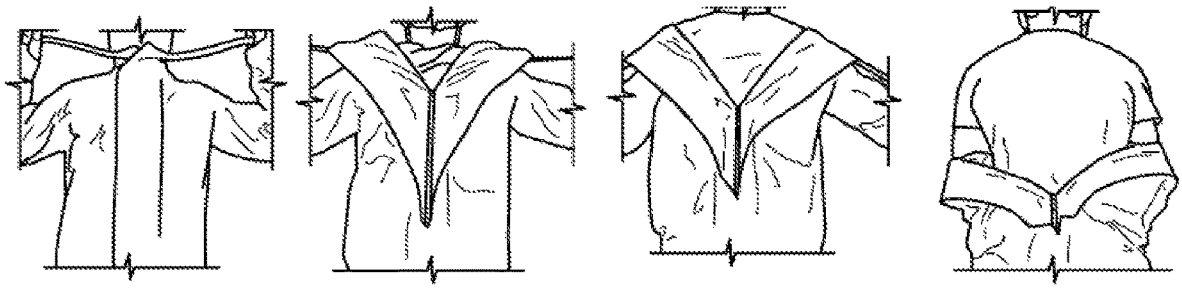
FIG. 10 shows the doffing process for a rear exit zipper and pull tabs.

Features of the Improved Coverall include: an entry and exit seam moved to rear of coverall; a standard zipper protected by an adhesive secured double storm flap; over the shoulder doffing pull-tabs; fingerless gloves; and dual color fabric—outer and potentially contaminated areas are yellow, inner areas are white. FIG. 9 shows a picture of the fingerless gloves with three symmetric bands, 91, passing through the fingers of a user. These elastic bands, 91, are designed to be ambidextrous. Embodiments can also contain 4 or more elastic bands. FIG. 10 shows the doffing process for a rear exit zipper and pull tabs. In FIG. 10, a user pulls tabs away from his/her body so as to open the rear exit seam of the suit.

The zipper is protected by a double storm flap to prevent contamination of the zipper area and to prevent accidental unzipping. The storm flaps are reinforced with a rigid material to ensure that they maintain their configuration throughout the time of use. At the top of each storm flap, there is a pull-tab which is secured to the front of the suit during use, and is pulled outwards during doffing to facilitate the removal of the suit. The fingerless gloves are worn over a pair of inner gloves and allow the easy removal of the outer gloves during doffing. Finally, the dual color of the coverall allows easy identification of areas of potential contamination. This further reduces the difficulty of doffing by adding visual cues to the doffing process. This doffing configuration was selected from many concepts based on user feedback as the most intuitive, easiest to doff, and least likely to cause contamination.

Example 4

Improved Hood

The Improved Hood is a head cover designed to address the following issues: to decrease the time and difficulty of doffing PPE; to improve visibility and recognition of HCWs; and to improve comfort of HCWs.

Figure 11:
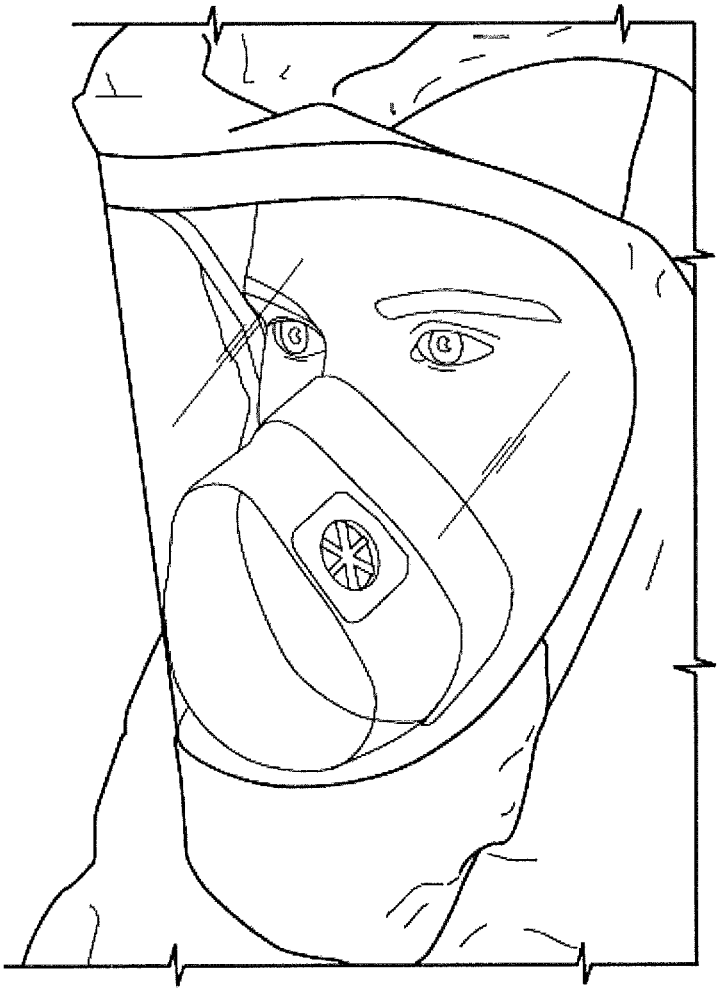
FIG. 11 shows a picture of an improved hood.

Features of the Improved Hood include: a large face shield; large integrated inhalation vents; an isolated exhalation pathway; optional compatibility with powered air supplies; and dual color fabric—outer and potentially contaminated areas are yellow, inner areas are white. FIG. 11 shows a picture of an improved hood.

Figure 12:
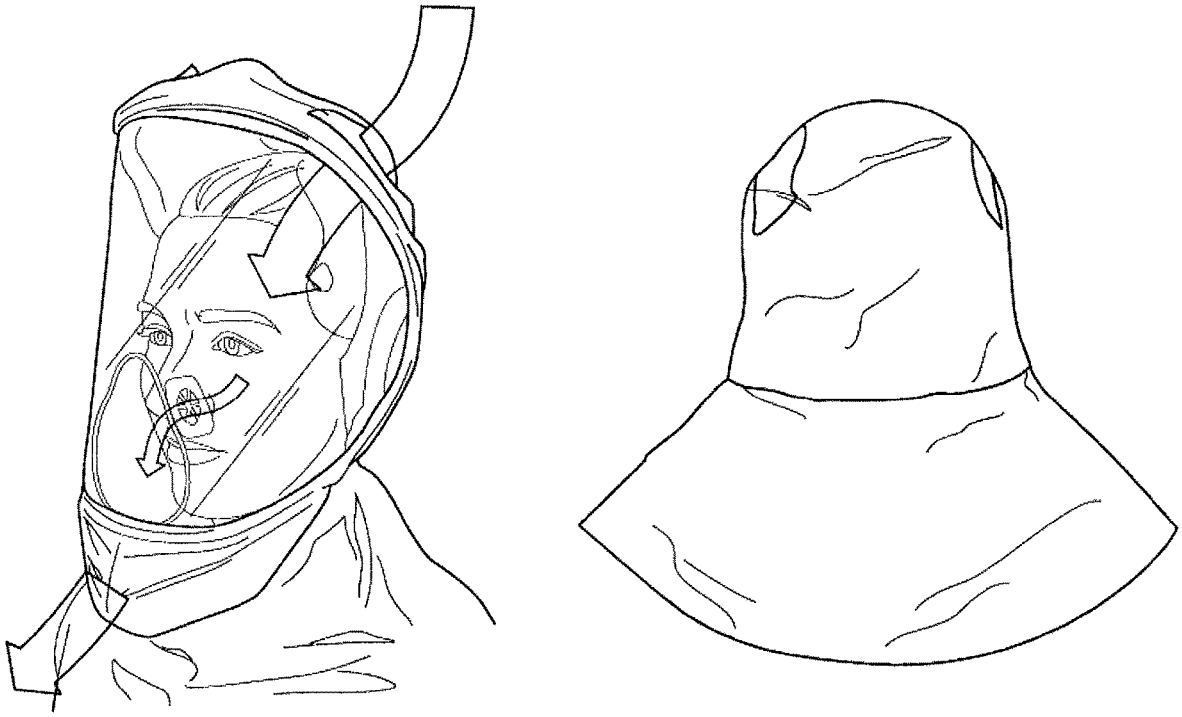
FIG. 12 shows the front exhalation pathway of the hood (arrow).

The Improved Hood decreases the time and difficulty of doffing by reducing head covering from multiple components (goggles, face mask, hood) to one easily removed piece. The Improved hood is worn in conjunction with a reusable face mask to limit costs. The large integrated inhalation vents and isolated exhalation pathway work together to decrease fogging by bringing fresh air into the hood upon each inhalation and discharging used air from the hood upon each exhalation as depicted in FIG. 12. FIG. 12 shows the front exhalation pathway of the hood (arrow). This contributes to increase ease of breathing and will have a significant impact on comfort and perceived heat. The large face shield increases the field of vision and improves patients' perception of HCWs wearing PPE. Finally, the Improved Hood can be used with powered air supplies to provide a continuous source of air. This allows the Improved Hood to work both with and without a PAPR, maximizing the possible market acceptance.

Example 5

Full Body Suit

The Full Body Suit is a rear-entry encapsulated coverall designed to address the three overarching needs in a single piece of PPE: to decrease the time and difficulty of doffing PPE; to improve visibility and recognition of HCWs; and to improve comfort of HCWs.

Figure 18:
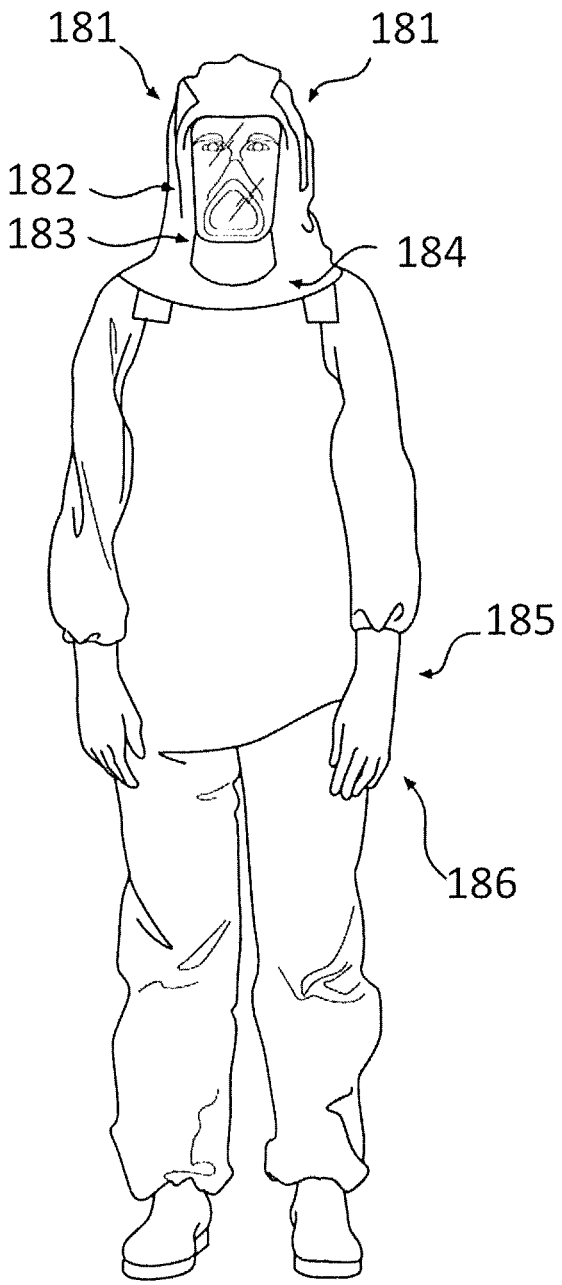
FIG. 18 shows a front view of a full body suit with rear entry.

Features of the Full Body Suit in this example include: an entry and exit seam moved to rear of coverall; a dual zipper protected by an adhesive secured double storm flap; doffing pull-tabs that part the double storm flap; fingerless gloves; dual color fabric—outer and potentially contaminated areas are yellow, inner areas are white; a large face shield; large integrated inhalation vents; an isolated exhalation pathway; optional compatibility with powered air supplies. FIG. 18 is a picture of the full body suit in this example.

Figure 13:
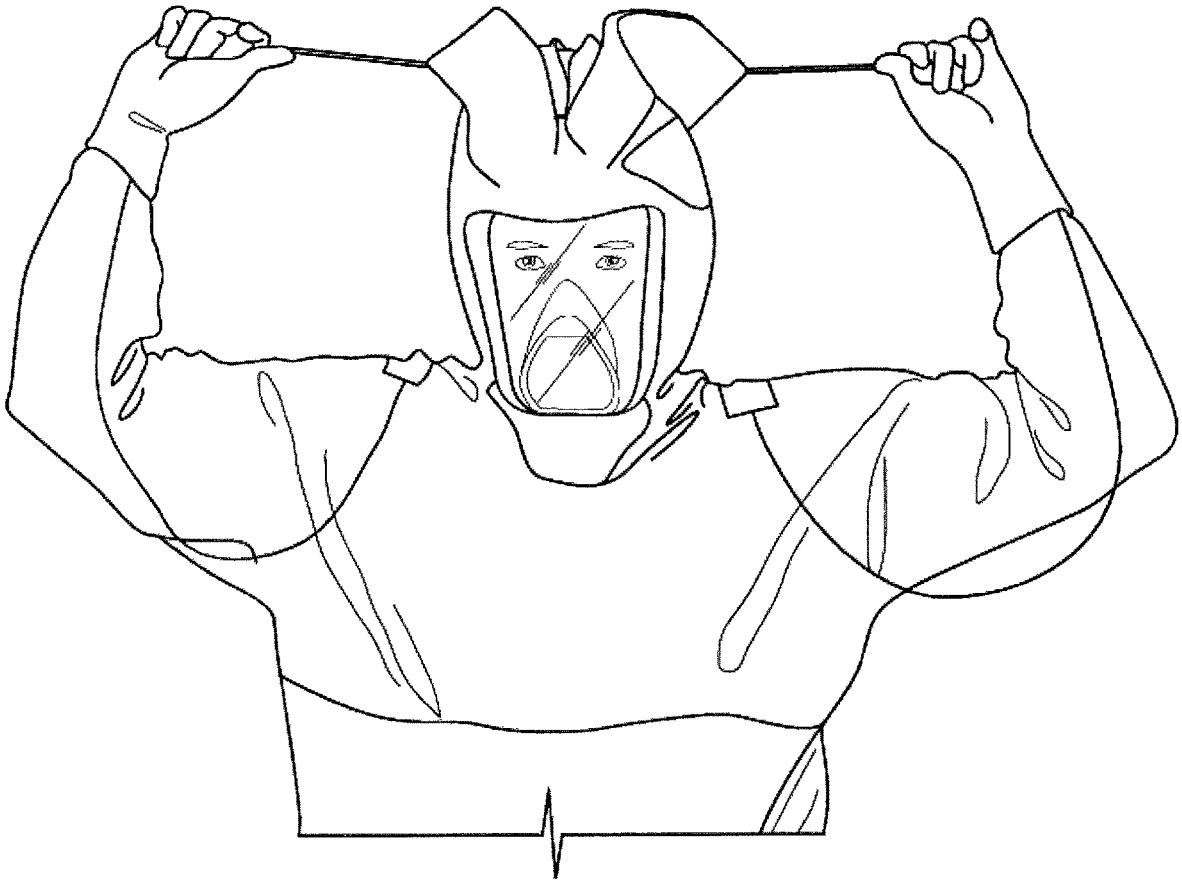
FIG. 13 shows doffing features of a full body suit.

Doffing features of the body suit include: The dual zipper opens the rear and the hood of the coverall and the two zipper pulls meet at the crown of the head. FIG. 13 shows doffing features of the full body suit. The entire length of the zipper is protected by a double storm flap to prevent contamination as well as accidental unzipping. The storm flaps are reinforced with a rigid material to ensure that they maintain their configuration throughout the time of use. At the crown of the head, doffing pull-tabs facilitate the removal of the suit. The fingerless gloves are worn over a pair of inner gloves and allow the easy removal of the outer gloves during doffing. The dual color further reduces the difficulty of doffing by adding visual cues to the doffing process. This doffing configuration was selected from many concepts based on user feedback as the most intuitive, easiest to doff, and least likely to cause contamination.

Figure 14:
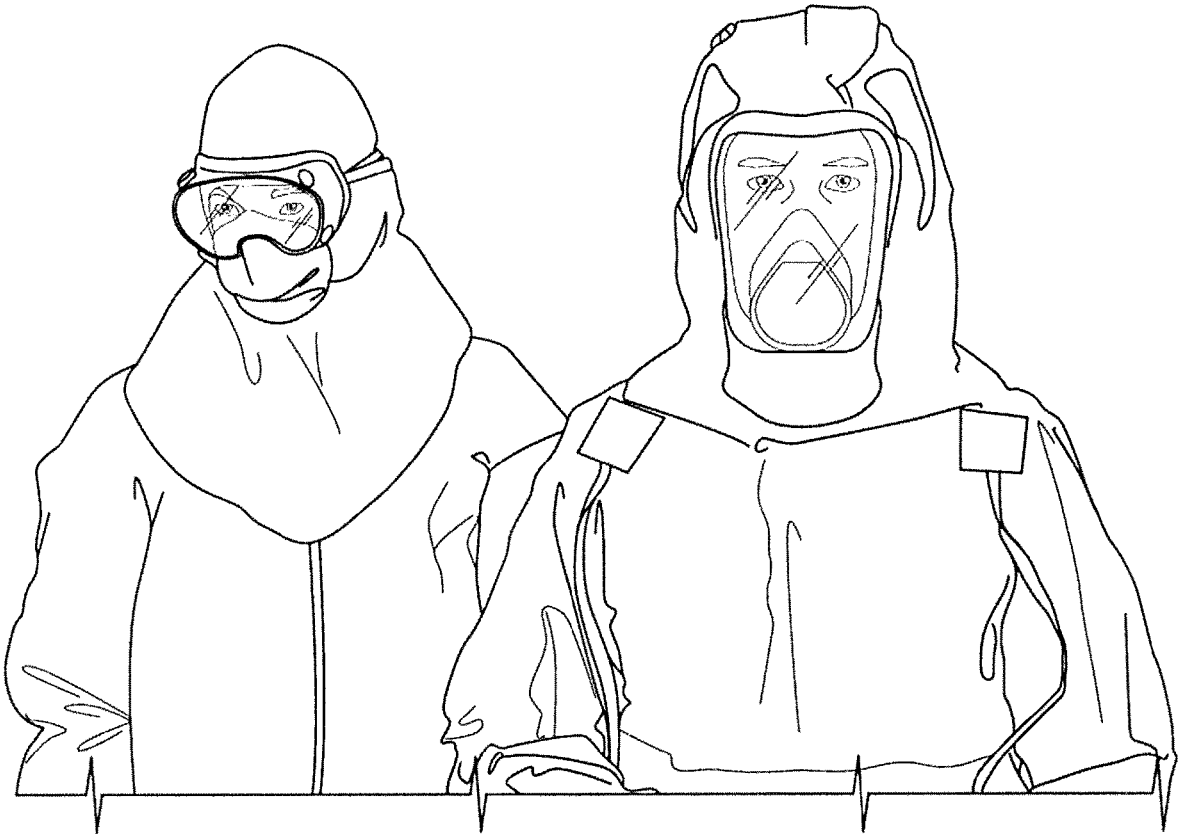
FIG. 14 shows features of the full body suit (right) as compared to features of currently worn PPE (left).

Comfort and Visibility features include: The large integrated inhalation vents and isolated exhalation pathway work together to decrease fogging by bringing fresh air into the hood upon each inhalation and discharging used air from the hood upon each exhalation. This contributes to increase ease of breathing and will have a significant impact on comfort and perceived heat. The large face shield increases the field of vision and improves patients' perception of HCWs wearing PPE. Finally, the hood of the Full Body Suit can be used with powered air supplies to provide a continuous source of air. This allows the hood to work both with and without a powered air supply, maximizing the possible market acceptance. FIG. 14 shows features of the full body suit (right) as compared to features of currently worn PPE (left).

The large face shield significantly improves a patient's ability to recognize a healthcare worker and provides a wider field of view for the healthcare worker.

Figure 15:
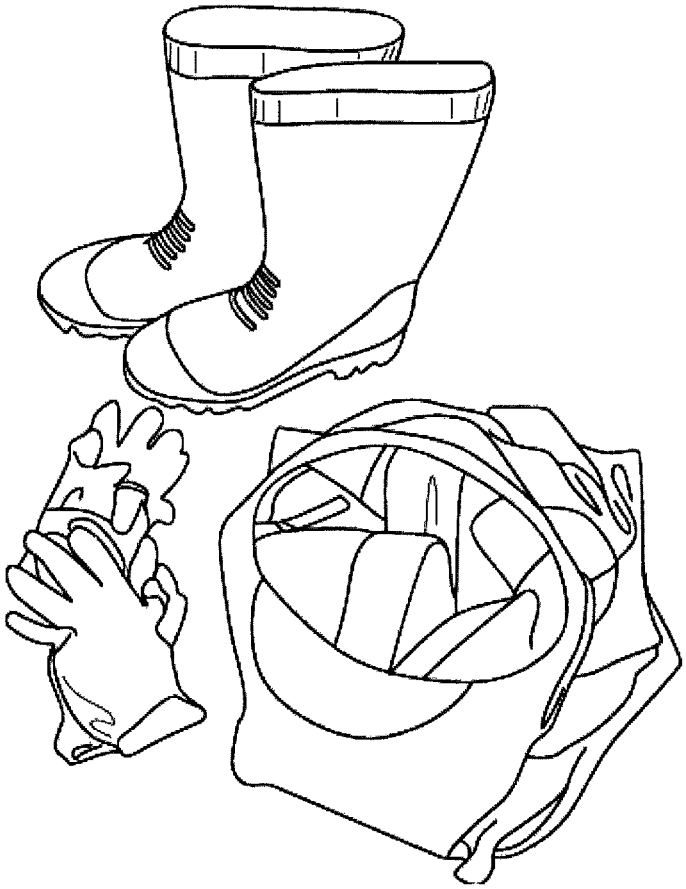
FIG. 15 shows the full body suit and additional PPE components.

Integration of the hood and the coverall result in significantly reduced time and difficulty of doffing. This design replaces a standard coverall, face mask, goggles, and hood with one item that is simpler to doff. FIG. 15 shows the full body suit and additional PPE components.

Example 6

Figure 16:
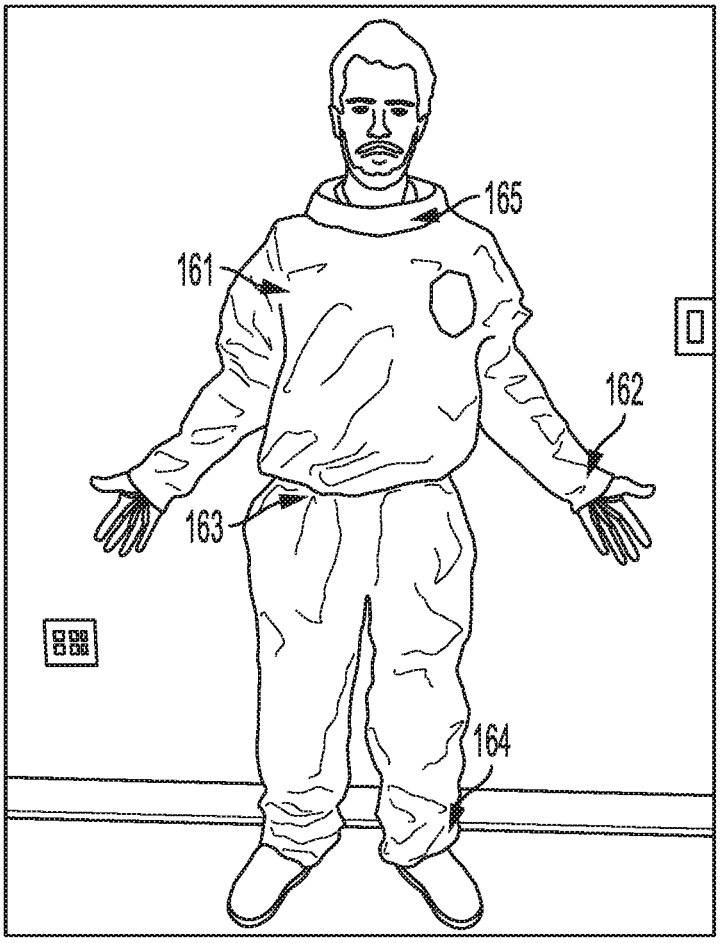
FIG. 16 shows a front view of a collared body suit with rear entry.
Figure 17:
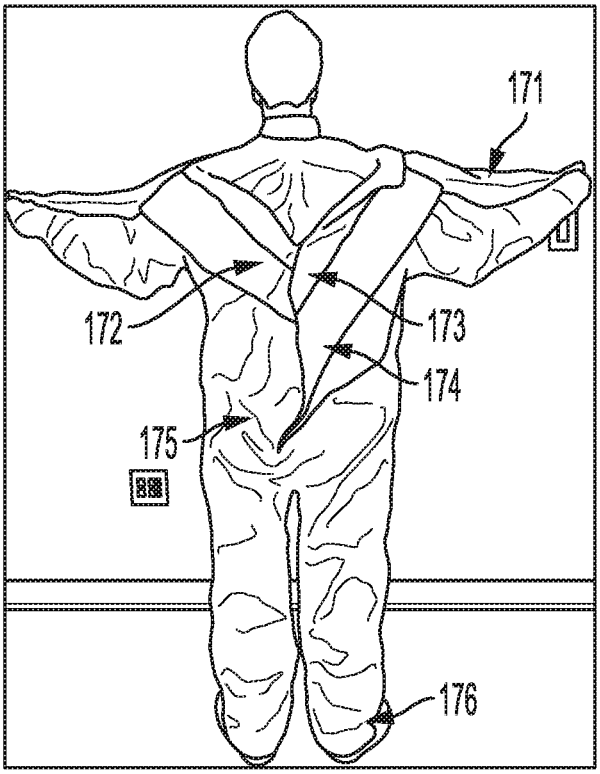
FIG. 17 shows a rear view of a collared body suit with rear entry.

FIG. 16 and FIG. 17 depict a front and rear view, respectively, of a collared body suit with rear entry. In FIG. 16, the suit has pull-away tabs with Velcro attachments to the front side of the suit, 161, elastic at the sleeves with elastic fingerless gloves, 162, an elastic waist band, 163, loose elastic at the ankles, 164, and a high collar, 165. In FIG. 17, the suit has pull-away tabs, 171, colored touch points (with a white TyVek interior), 172, a rear non-locking zipper, 173, storm flaps with rigid material and adhesive, 174, an elastic waist band, 175 and lose elastic bands at the ankles, 176. The suit has pull tabs that are positioned ontot he storm flaps at angles from 45-135 degrees. In the example shown, the tabs are positioned at an angle of 90 degrees. Also, the pull tabs are at least 10 cm in length. The length can vary greatly so long as the tabs are long enough to be attached to the front side of the body suit.

Example 7

Figure 19:
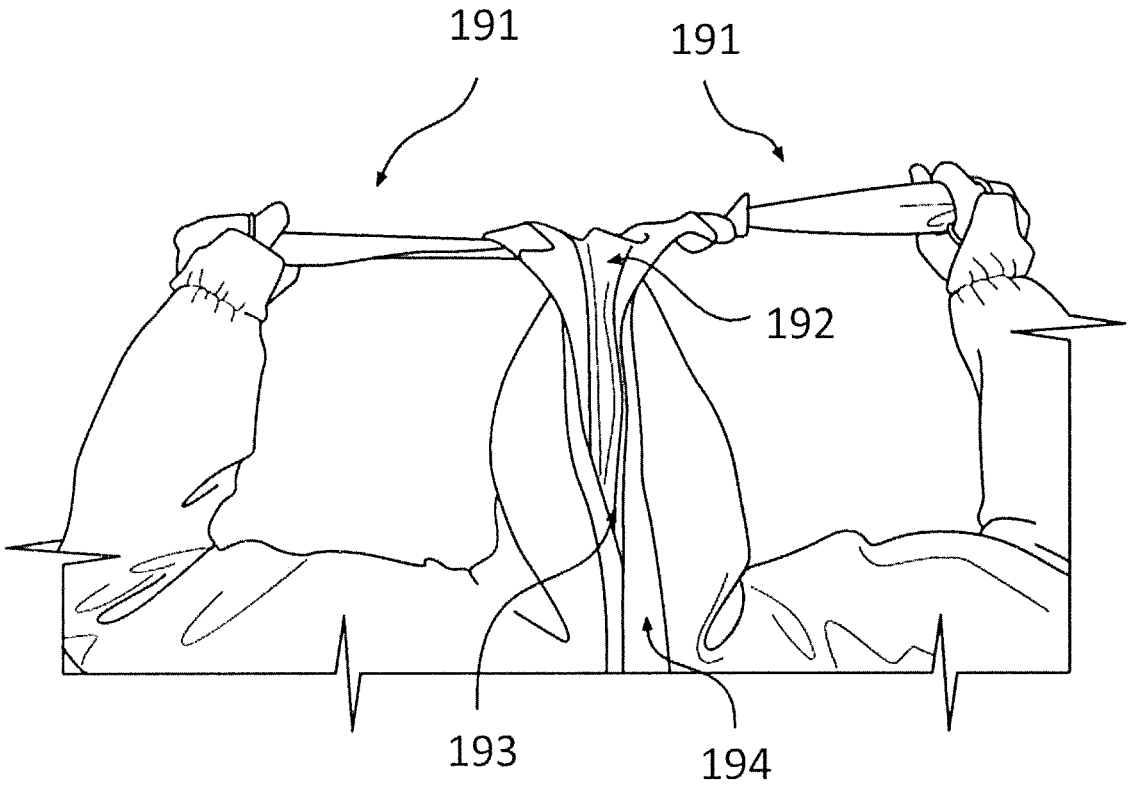
FIG. 19 shows a rear view of a full body suit with rear entry.

FIG. 18 and FIG. 19 depict a front and rear view, respectively, of a full body suit with rear entry. In FIG. 18, the suit has integrated inhalation vents, 181, a large face shield, 182, a clear face mask, 183, an isolated exhalation pathway, 184, elastic sleeves, 185, and fingerless gloves, 186. In FIG. 19, the suit has pull-away tabs, 191, at the top of the hood in between two sets of storm flaps, 2 rear opposite facing non-locking zippers, 192, colored touch points beneath storm flaps, 193, and storm flaps with rigid material and adhesive, 194. Also, the pull tabs 191 are at least 3 cm in length.

Example 8

Figure 20:
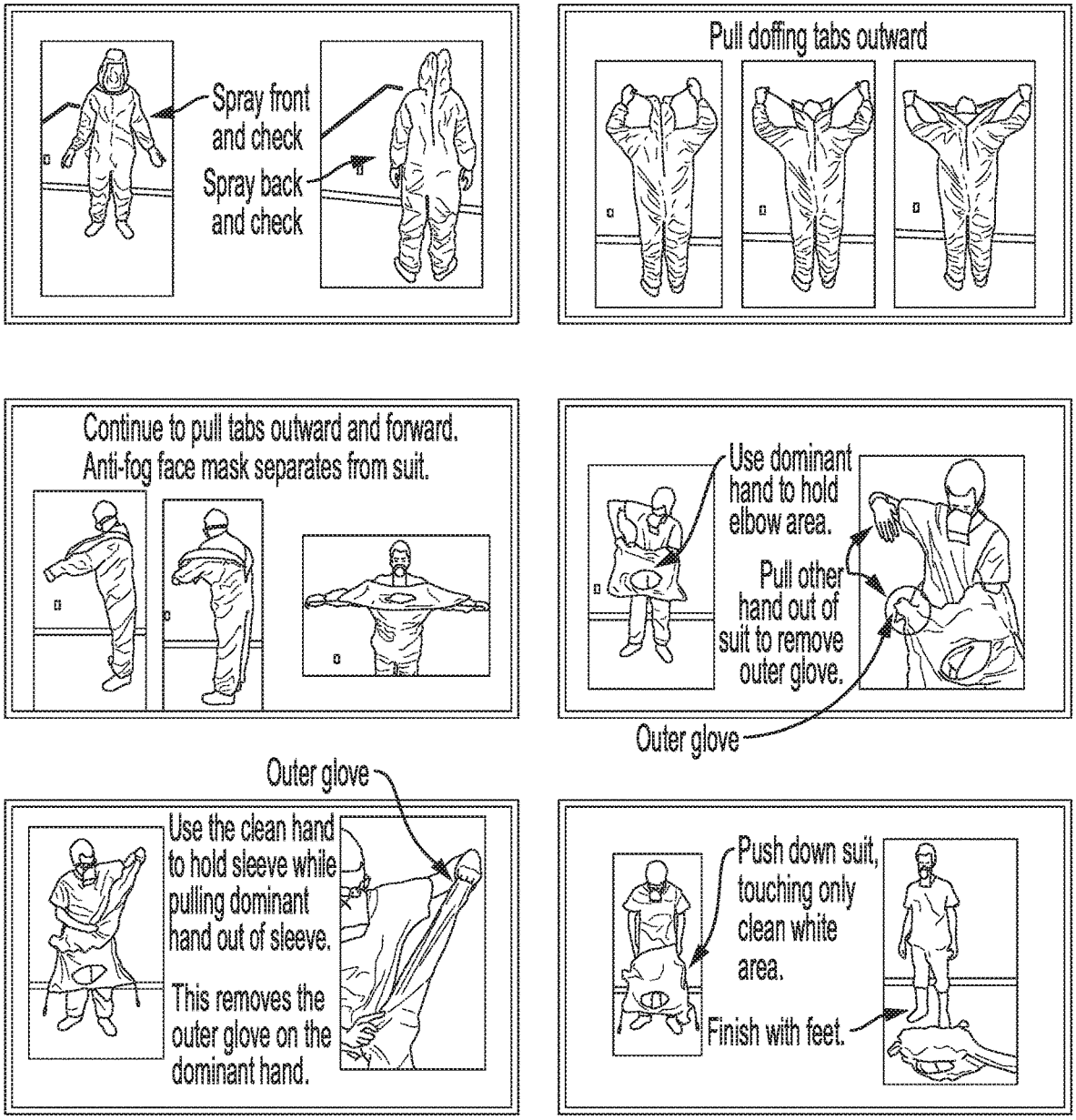
FIG. 20 shows a doffing process.

FIG. 20 shows a story board for a doffing procedure for a full body suit. From top left panel to bottom right panel: 1) the suit is sprayed at the front and back; 2) the wearer then pulls apart doffing tabs attached to the top of the hood; 3) the tabs are pulled apart until the suit is opened to about or below the center of the back of a wearer and such that the face mask separates from the wearer and hangs below the face of a wearer; 4) the wearer uses a first hand to hold the suit at the elbow region of the aim opposite the first hand and pulls out a second hand an arm that is opposite the first hand and such that the second hand and arm are removed from the suit and exterior glove; 5) the wearer then uses the freed hand (the second hand) to hold an interior portion of a sleeve of the suit and pulls the first hand and arm out of the suit, resulting in freeing of the first hand and arm from the suit and exterior glove; 6) the wearer then uses the freed first and second hands to push on an interior part of the suit, pushing the suit beneath the wearer's waist region; 7) the wearer then uses his/her feet to push the off the suit.

TABLE 1

Various Features and Methods of various example body suits

| Name of Feature or Method | Description/Claim | Objective |
|---|---|---|
| Rear entry and exit seam: non-locking zipper (break-away zipper) | One downwards facing non-locking rear zipper in the coverall. Two opposite facing non-locking rear zippers in the full body suit. Zippers open easily when tabs are pulled on | Improves ease of doffing (decrease the risk of contamination, reduce the number of steps, and reduce the time required to doff PPE) |
| Ambidextrous fingerless gloves (3 part) | Elastic fingerless gloves integrated into the sleeves of the coveralls and full body suit to ensure the external gloves easily come off with the suit during the doffing process | Improves ease of doffing |

TABLE 1-continued

Various Features and Methods of various example body suits

| Name of Feature or Method | Description/Claim | Objective |
|---|---|---|
| Square/rectangular shaped pull-away tabs | Tabs anchored to zipper end at an angle in order to facilitate easy opening of break away zipper. Attach to the front of the suit during use via adhesive or Velcro, easily detachable when doffing | Improves ease of doffing |
| Circular/hook shaped pull-away tabs | Located on storm flaps, in between two opposite facing zippers to facilitate zipper opening from the top of head | Improves ease of doffing |
| Elastic sleeve ends | Upper limb opening-elastic sleeve below fingerless gloves to secure gloves in place and reduce contamination | Improves ease of doffing |
| Loose elastic at ankles | Lower limb opening-elastic at ankles that is loose enough to facilitate easy doffing | Improves comfort |
| Colored touch points | Different color above and beneath storm flaps to indicate where to differentiate between contaminated and non-contaminated regions | Improves ease of doffing |
| Storm flaps with rigid material and adhesive | Cover the zipper area to reduce risk of contamination. Facilitate a curl-away motion of the garment while doffing to encase contamination | Improves ease of doffing |
| Integrated hood | Creates seamless, impermeable barrier to cover face, and is removed in one step along with the rest of the suit | Improves ease of doffing |
| Unpowered respiratory hood with large transparent face shield | Large transparent visor decreases patient apprehension and increases health care worker visibility | Improves visibility |
| High surface area inhale vents on hood | Passive cooling- Pulls less saturated air in from the environment over the inside of the visor when the user inhales. Reduces resistance to breathing | Improves comfort |
| Clear face mask with inhalation and exhalation valves integrated into the face shield (reusable or disposable) | Clear face mask (so that clinicians mouth is visible), with inhale and exhale vents to direct airflow and reduce fogging | Improves visibility and comfort |
| Clear face mask with inhalation and exhalation valves not integrated into the face shield (reusable or disposable) | Clear face mask (so that clinicians mouth is visisble), with inhale and exhale vents to direct airflow and reduce fogging | Improves visibility and comfort |
| Isolated exhalation pathway/vents on face shield | Directs air out the bottom of the hood using the same one way valves used in standard N95 respirator masks. This keeps the hot moist air away from the visor | Improves comfort |
| Cocoon doffing method | Built-in disposal of the contaminated suit | Improves ease of doffing |
| Elastic waistband | Allows suit to fit a larger range of body sizes | Improves comfort |
| Drawstring for adjustable sizing-one size fits all | Achieved by drawstring and elastic, fitted internally with high-waist pants for improved comfort and reduced risk of tripping or splashing | Improves ease of doffing, improves comfort |
| Baffle of clean fabric built into zipper | To catch possible contamination on the back of the health care worker | Improves ease of doffing |
| Doffing tabs on the sleeve | For safe removal of the suit without an assistant | Improves ease of doffing |
| Parallel zipper to zip lock seam | Design covered with a Velcro tab allows for single entry and single break-away exit | Improves ease of doffing |

TABLE 1-continued

Various Features and Methods of various example body suits

| Name of Feature or Method | Description/Claim | Objective |
|---|---|---|
| Added rigidity alongside zipper | Improves ease of doffing without an assistant | Improves ease of doffing |
| Added rigidity alongside zipper with curled treatment | Facilitates a curl-away motion of the garment while doffing to encase contamination | Improves ease of doffing |
| Fingerless glove liner | Integrated into the arms of the coveralls to ensure the external gloves easily come off with the suit during the doffing process | Improves ease of doffing |
| Large face shield and transparent hood | Decreases patient apprehension and increases HCW visibility | Improves visibility |
| Second layer of fabric beneath exit seam | Second layer of protection against contamination while doffing | Improves ease of doffing |
| Reusable moisture wicking base layer | Replaces scrubs and provides dry skin, wicking and evaporative cooling when exposed to air flow inside suit and once outer PPE is doffed | Improves comfort |
| Colored interior layer | Allows for quick identification of breaches | Improves ease of doffing |
| Hook-in doffing method | Loop tabs on the hood and wrists allows self-doffing by attaching to hooks | Improves ease of doffing |
| Double-glove screen barrier | Integrated outer layer gloves and can be reused and used with fewer layers of gloves on the body of the health care worker | Improves safety |

REFERENCES

Baker, Aryn. "Why Protective Gear Is Sometimes Not Enough in the Fight Against Ebola." *TIME*. Oct. 15, 2014. http://time.com/3509980/ebola-protection-mistakes/

Beaubien, Jason. "Firestone Did What Governments Have Not: Stopped Ebola In Its Tracks." *National Public Radio*. Oct. 6, 2014. http://www.npr.org/blogs/goatsandsoda/2014/10/06/354054915/firestone-did-what-governments-have-not-stopped-ebola-in-its-tracks Benton, Grace. "ICT empowers communities in fight against Ebola." *eLearning Africa News*. Nov. 14, 2014. http://www.elearning-africa.com/eLA_Newsportal/ict-ebola-Sierra-Leone/

"CEPAR Tracking and Responding to EBOLA." *Johns Hopkins Office of Critical Event Preparedness and Response*. 2014. http://www.hopkins-cepar.org/

Cheng, Maria. "WHO: 10,000 new Ebola cases per week could be seen." *Associated Press*. Oct. 14, 2014. http://bigstory.ap.org/article/77bf113e7b314fa7aa2ec891c2e7c7b9/who-10000-new-ebola-cases-week-could-be-seen Davis, Rebecca. "Panic In The Parking Lot: A Hospital Sees Its First Ebola Case." *National Public Radio*. Oct. 14, 2014. http://www.npr.org/2014/10/14/356045068/u-s-doctor-witnesses-unfolding-ebola-epidemic-at-liberian-hospital "Dean's Symposium on Ebola." *Johns Hopkins Bloomberg School of Public Health*. Oct. 14, 2014. http://www.jhsph.edu/events/2014/ebola-forum/social-media-and-multimedia-links.html "Ebola." *USAID. http://www.usaid.gov/ebola*

"Ebola Deeply." *Ebola Deeply*. 2014. www.eboladeeply.org

"Ebola virus disease." *World Health Organization*. 2014. http://www.who.int/csr/disease/ebola/en/

"Global Alert and Response." *World Health Organization*. 2014. http://www.who.int/csr/disease/ebola/situation-reports/en/

Kelion, Leo. "Ebola text-message system set to expand." *BBC. Oct*. 14, 2014. http://www.bbc.com/news/technology-29610865

"Life inside a Liberian Ebola Treatment Unit." *ABC News*. 2014. http://abcnews.go.com/International/video/life-inside-liberian-ebola-treatment-unit-25873937

Martin, Kim. "HC3 Launches Ebola communication network to house Ebola resources, tools" *Health Communication Capacity Collaborative*. Oct. 8, 2014. http://www.healthcommcapacity.org/hc3-launches-ebola-communication-network-house-ebola-resources-tools/

"MSF rejects Ebola cash asks Australia for medics." *Aljazeera*. Oct. 2, 2014. http://www.aljazeera.com/news/africa/2014/10/msf-rejects-ebola-cash-asks-medics-201410210414437521.html Penfold, Erica et. al. "Ebola and Cultures of Engagement: Chinese Versus Western Health Diplomacy." *Council of Councils*. Oct. 3, 2014. http://www.cfr.org/councilofcouncils/global_memos/p33560

"Personal Protective Equipment." *United States Department Of Labor Occupational Safety & Health Administration*. 2014. https://www.osha.gov/SLTC/personalprotective-equipment/construction.html "Understanding the Ebola Virus and How You Can Avoid It." *Alison*. 2014. http://alison.com/courses/Understanding-the-Ebola-Virus-and-How-You-Can-Avoid-It Watson, Leon. "WHO says Ebola is 'most severe acute health emergency in modem times'." *The Telegraph*. Oct. 13, 2014. http://www.telegraph.co.uk/news/worldnews/ebola/11158504/WHO-says-Ebola-is-most-severe-acute-health-emergency-in-modern-times.html "What should Ebola health care workers wear?" *CBS News*. Oct. 17, 2014. http://www.cbsnews.com/news/what-should-ebola-health-care-workers-wear/

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

We claim:

1. A bodysuit for use as a personal protective equipment item comprising:

a torso portion comprising:

a front side;

a back side including a sealable port through which a wearer can enter and exit the bodysuit when donning or doffing the bodysuit, respectively;

a waist region;

a neck opening;

a pair of upper limb openings; and a pair of lower limb openings;

two arm portions each extending from one of the upper limb opening; and two leg portions each extending from one of the lower limb opening, wherein said sealable port further comprises a zipper for opening and closing said sealable port, wherein said sealable port further comprises a first storm flap and a second storm flap, wherein said first storm flap overlaps with said second storm flap and wherein said first storm flap and said second storm flap form a cover over said zipper when overlapped, wherein said first storm flap and said second storm flap further comprise an adhesive material, and wherein said first storm flap further comprises a first pull tab joined at a first end to said first storm flap at the neck opening and extending therefrom, and wherein second storm flap further comprises a second pull tab joined at a first end to said second storm flap at the neck opening and extending therefrom.

2. The bodysuit of claim 1, wherein said zipper further comprises a pull tab.

3. The bodysuit of claim 2, wherein said pull tab is attached to said zipper at an angle.

4. The bodysuit of claim 1, wherein said zipper is a non-locking zipper.

5. The bodysuit of claim 1, wherein said first storm flap and said second storm flap contain an embedded rigid material.

6. The bodysuit of claim 1, wherein said first storm flap and said second storm flap comprise a rigid material.

7. The body suit of claim 1, wherein said first pull tab and said second pull tab are attached to said first storm flap and said second storm flap at an angle between 45 and 135 degrees.

8. The body suit of claim 1, wherein said first pull tab and said second pull tab are each at least 10 centimeters in length.

9. The body suit of claim 1, wherein said first pull tab and said second pull tab are each at least 20 centimeters in length.

10. The body suit of claim 1, wherein said first pull tab is removably attached to said front side at an end opposite to said first end, and wherein said second pull tab is removably attached to said front side at an end opposite said first end.

11. The bodysuit of claim 1, further comprising a second layer of fabric positioned beneath said sealable port.

12. The bodysuit of claim 1, wherein an outer surface or a portion thereof of said bodysuit comprises a first color and wherein an inner surface or a portion thereof of said bodysuit comprises a second color.

13. The bodysuit of claim 1, further comprising integrated fingerless gloves disposed on said arm portions distal to said upper limb openings.

14. The bodysuit of claim 13, wherein said integrated fingerless gloves are symmetric bands.

15. The bodysuit of claim 13, wherein said integrated fingerless gloves are three or more symmetric bands.

16. The bodysuit of claim 1, further comprising an elastic band positioned internally at said waist region.

17. The bodysuit of claim 1, further comprising elastic sleeves disposed on said arm portions in alignment with wrist regions of a wearer when said bodysuit is worn.

18. The bodysuit of claim 1, wherein said lower limb openings further comprise elastic ends disposed on said lower limb portions in alignment with ankle regions of a wearer when said bodysuit is worn.

19. The bodysuit of claim 1, further comprising an integral hood attached at the neck opening, said integral hood comprising:

a front side with a transparent face shield;

a back side, and an opening extending from the back side of said bodysuit through the back side of the integral hood to a top end of the integral hood wherein said opening is continuous with said sealable port, wherein said opening further comprises a first zipper and a second zipper for opening and closing of said opening and sealable port, wherein said first zipper and said second zipper meet at a top end of the integral hood at a region corresponding to a crown region of a head of said wearer when said bodysuit is worn, wherein said opening and sealable port further comprises a first storm flap and a second storm flap, wherein said first storm flap overlaps with said second storm flap and wherein said first storm flap and said second storm flap form a cover over each of said first zipper and said second zipper when overlapped, wherein said first storm flap and said second storm flap further comprise an adhesive material, and wherein said first storm flap comprises a first pull tab joined at a first end to said first storm flap at a region corresponding to a crown region of a head of a wearer when said bodysuit is worn and extending therefrom, and wherein said second storm flap comprises a second pull tab joined at a first end to said second storm flap at a region corresponding to a crown region of a head of a wearer when said bodysuit is worn and extending therefrom.

20. The bodysuit of claim 19, wherein each of said first zipper and said second zipper is a non-locking zipper.

21. The bodysuit of claim 19, wherein said first storm flap and said second storm flap are embedded with a rigid material.

22. The bodysuit of claim 19, wherein said first storm flap and said second storm flap comprise a rigid material.

23. The bodysuit of claim 19, wherein said first pull tab and second pull tab are each at least 3 centimeters in length.

24. The bodysuit of claim 19, wherein said integral hood further comprises an inhalation vent and an exhalation pathway.

25. The bodysuit of claim 24, wherein said inhalation vent is positioned on said integral hood to a region corresponding to above of a head of a wearer, a region corresponding to beside a face of a wearer, a region corresponding to an ear of a wearer, or alongside the transparent face shield, and wherein said exhalation pathway is positioned on said integral hood to a region corresponding to a mouth and nose of a wearer, beneath said transparent face shield, or a combination thereof.

26. The bodysuit of claim 19, further comprising a second layer of fabric positioned beneath said opening and sealable port.

27. The bodysuit of claim 19, wherein an outer surface or portion thereof of said bodysuit comprises a first color and wherein an inner surface or portion thereof of said bodysuit comprises a second color.

28. The bodysuit of claim 19, further comprising integrated fingerless gloves disposed on said arm portions distal said upper limb openings.

29. The bodysuit of claim 28, wherein said integrated fingerless gloves are symmetric bands.

30. The bodysuit of claim 28, wherein said integrated fingerless gloves are three or more symmetric bands.

31. The bodysuit of claim 19 further comprising:

a hood tab disposed on the top end of said integral hood.

32. The bodysuit of claim 19, further comprising an elastic band positioned internally at said waist region.

33. The bodysuit of claim 19, further comprising elastic sleeves such that said elastic sleeves disposed on said arm portions in alignment with wrist regions of a wearer when said bodysuit is worn.

34. The bodysuit of claim 19, wherein said lower limb openings further comprise elastic ends disposed on said lower limb portions in alignment with ankle regions of a wearer when said bodysuit is worn.

* * * * *